US008826990B2

(12) United States Patent
Botich

(10) Patent No.: US 8,826,990 B2
(45) **Date of Patent: *Sep. 9, 2014**

(54) APPARATUSES AND METHODS FOR CLOSING AND REOPENING A PIPE

(75) Inventor: Leon A. Botich, Monee, IL (US)

(73) Assignee: Deep Sea Innovations, LLC, Monee, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/250,098

(22) Filed: Sep. 30, 2011

(65) Prior Publication Data

US 2012/0090850 A1 Apr. 19, 2012

Related U.S. Application Data

(63) Continuation-in-part of application No. 13/183,267, filed on Jul. 14, 2011, now Pat. No. 8,485,261.

(60) Provisional application No. 61/364,569, filed on Jul. 15, 2010, provisional application No. 61/371,834, filed on Aug. 9, 2010, provisional application No. 61/415,105, filed on Nov. 18, 2010.

(51) Int. Cl.

| | |
|---|---|
| ***E21B 7/12*** | (2006.01) |
| ***E21B 33/035*** | (2006.01) |
| ***E21B 43/01*** | (2006.01) |
| ***E21B 33/064*** | (2006.01) |
| ***E21B 34/00*** | (2006.01) |
| ***E21B 34/04*** | (2006.01) |

(52) U.S. Cl.

CPC ..... *E21B 33/035* (2013.01); *E21B 43/0122* (2013.01); *E21B 33/064* (2013.01); *E21B 34/00* (2013.01); *E21B 34/045* (2013.01)

USPC ..... 166/364; 166/363; 166/338; 166/341

(58) Field of Classification Search

CPC ..... E21B 33/00; E21B 33/037; E21B 33/06; E21B 33/04; E21B 33/068

USPC ..... 166/363, 364, 338, 341, 343, 351, 365, 166/368, 356; 251/1.1; 210/922; 169/69

See application file for complete search history.

(56) References Cited

U.S. PATENT DOCUMENTS

| | | | |
|---|---|---|---|
| 1,839,394 | A | 1/1932 | Inge |
| 2,465,727 | A | 3/1949 | Jensen |

(Continued)

OTHER PUBLICATIONS

International Search Report and Written Opinion for corresponding PCT Patent Application No. PCT/US11/44050 dated Dec. 13, 2011, 11 pgs.

(Continued)

*Primary Examiner* — Matthew Buck
*Assistant Examiner* — Aaron Lembo
(74) *Attorney, Agent, or Firm* — Marshall, Gerstein & Borun LLP

(57) ABSTRACT

A method for installing a pipe closing apparatus in an oil well rig system positioned at least partially in a body of water, comprising the steps of shutting off a flow of oil through a well head, removing a section of riser pipe from the oil well rig system and connecting the pipe closing apparatus to a remaining portion of riser pipe and positioning the pipe closing apparatus between the remaining portion of riser pipe and the well head.

20 Claims, 18 Drawing Sheets

(56) References Cited

U.S. PATENT DOCUMENTS

| | | | | |
|---|---|---|---|---|
| 2,745,497 | A | 5/1956 | Dale et al. | |
| 2,999,545 | A | 9/1961 | Bigelow | |
| 3,070,129 | A | 12/1962 | Poulallion et al. | |
| 3,577,737 | A | 5/1971 | Burleson | |
| 3,899,024 | A | 8/1975 | Tonnelli et al. | |
| 3,998,245 | A | 12/1976 | Martin | |
| 3,999,617 | A * | 12/1976 | Ilfrey et al. | 175/7 |
| 4,095,421 | A | 6/1978 | Silcox | |
| 4,109,716 | A | 8/1978 | Canalizo | |
| 4,209,270 | A * | 6/1980 | Billingsley | 405/224.2 |
| 4,249,576 | A | 2/1981 | Streich et al. | |
| 4,405,014 | A | 9/1983 | Talafuse | |
| 4,624,312 | A | 11/1986 | McMullin | |
| 4,967,842 | A | 11/1990 | Franceschini et al. | |
| 5,058,684 | A | 10/1991 | Winslow et al. | |
| 5,076,311 | A | 12/1991 | Marschke | |
| 5,267,612 | A | 12/1993 | Cassin | |
| 5,357,999 | A | 10/1994 | Loth et al. | |
| 5,551,802 | A * | 9/1996 | Wybro | 405/223.1 |
| 5,735,502 | A | 4/1998 | Levett et al. | |
| 5,950,725 | A | 9/1999 | Rondeau et al. | |
| 6,334,488 | B1 | 1/2002 | Freiheit | |
| 6,457,526 | B1 * | 10/2002 | Dailey | 166/338 |
| 7,134,498 | B2 * | 11/2006 | Hopper | 166/357 |
| 7,210,535 | B2 | 5/2007 | Turner | |
| 7,469,742 | B2 | 12/2008 | Larsen | |
| 7,500,516 | B2 | 3/2009 | Borak | |
| 7,717,136 | B2 | 5/2010 | Sakai | |
| 7,762,282 | B2 | 7/2010 | Coscarella | |
| 2002/0157828 | A1 | 10/2002 | King et al. | |
| 2004/0055741 | A1 | 3/2004 | Pedersen et al. | |
| 2005/0077043 | A1 | 4/2005 | Dallas | |
| 2005/0217868 | A1 | 10/2005 | Dallas et al. | |
| 2006/0065403 | A1 | 3/2006 | Watson et al. | |
| 2006/0151183 | A1 | 7/2006 | Turner | |
| 2007/0034379 | A1 | 2/2007 | Fenton et al. | |
| 2007/0079990 | A1 | 4/2007 | Borak | |
| 2007/0277968 | A1 | 12/2007 | McGuire et al. | |
| 2007/0289745 | A1 | 12/2007 | Richards | |
| 2008/0023917 | A1 | 1/2008 | Khandoker | |
| 2008/0251251 | A1 | 10/2008 | Dallas et al. | |
| 2008/0302536 | A1 * | 12/2008 | Kotrla et al. | 166/341 |
| 2010/0212156 | A1 | 8/2010 | Judge et al. | |

OTHER PUBLICATIONS

International Preliminary Report on Patentability for PCT Patent Application No. PCT/US11/44050 dated Oct. 15, 2012, 4 pgs.

Office Action for U.S. Appl. No. 13/183,267 dated Nov. 14, 2012, 10 pgs.

* cited by examiner 20
142
27
133
125
28
49
52
25
26
45
34
132
143
46
41
30
38
43
44
122
48
124
40
47
60
50
62
25
58
90
36
128
42
64
120
126
66
52
98
68
72
27
122
52
88
88
84
86
96
75
77
73
70
104
80
137
136
94
128
100
78
82
125'
147
127
116
116
116
154
154
152
102
22
92
191

114
118
128
128
150
150
126
120'
109
146
111
111
119
119
113
113
106
111
24
111
108
129
110
112

APPARATUSES AND METHODS FOR CLOSING AND REOPENING A PIPE

RELATED APPLICATIONS

The present application claims the benefit of co-pending U.S. patent application Ser. No. 13/183,267, filed Jul. 14, 2011, which, in turn claims priority to U.S. Provisional Patent Application No. 61/364,569, filed Jul. 15, 2010, U.S. Provisional Patent Application No. 61/371,834, filed Aug. 9, 2010, and U.S. Provisional Patent Application No. 61/415,105, filed Nov. 18, 2010, the entire contents of all are incorporated herein by reference.

FIELD OF THE INVENTION

The present invention generally relates to apparatuses and methods for closing and re-opening a pipe and, more particularly, to apparatuses and methods for closing and re-opening an opening in a pipe wherein the pipe is positioned in a high pressure environment such as provided in underwater environment in the great depths of the ocean.

SUMMARY

A method for installing a pipe closing apparatus in an oil well rig system positioned at least partially in a body of water, comprising the steps of shutting off a flow of oil through a well head, removing a section of riser pipe from the oil well rig system and connecting the pipe closing apparatus to a remaining portion of riser pipe and positioning the pipe closing apparatus between the remaining portion of riser pipe and the well head.

Figure 1:
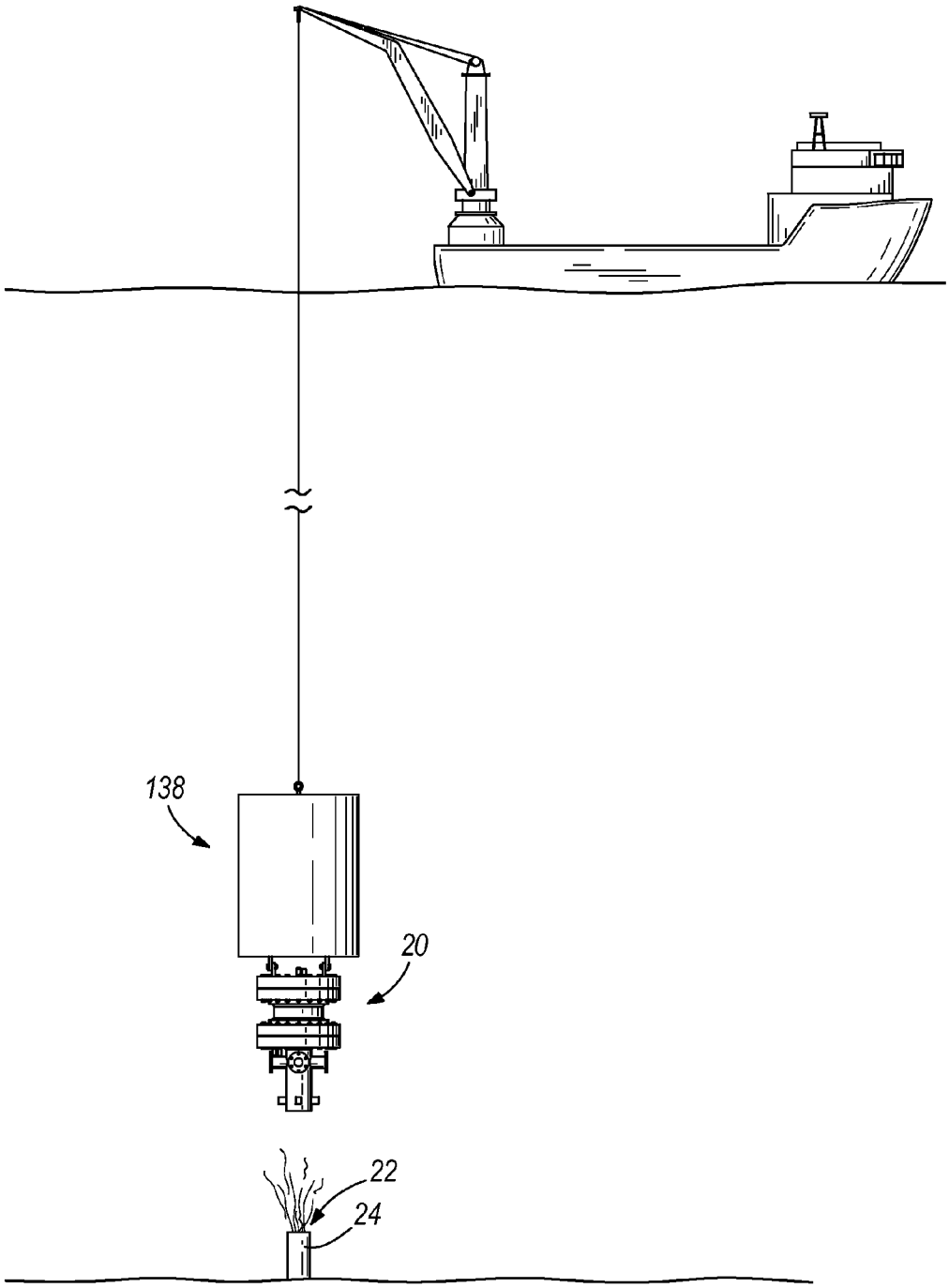
FIG. 1 is a schematic view of a pipe closing apparatus being lowered into position to close an open riser pipe of an oil well at the ocean floor.

Before any independent features and embodiments of the invention are explained in detail, it is to be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is for the purpose of description and should not be regarded as limiting.

DETAILED DESCRIPTION

Figure 2:
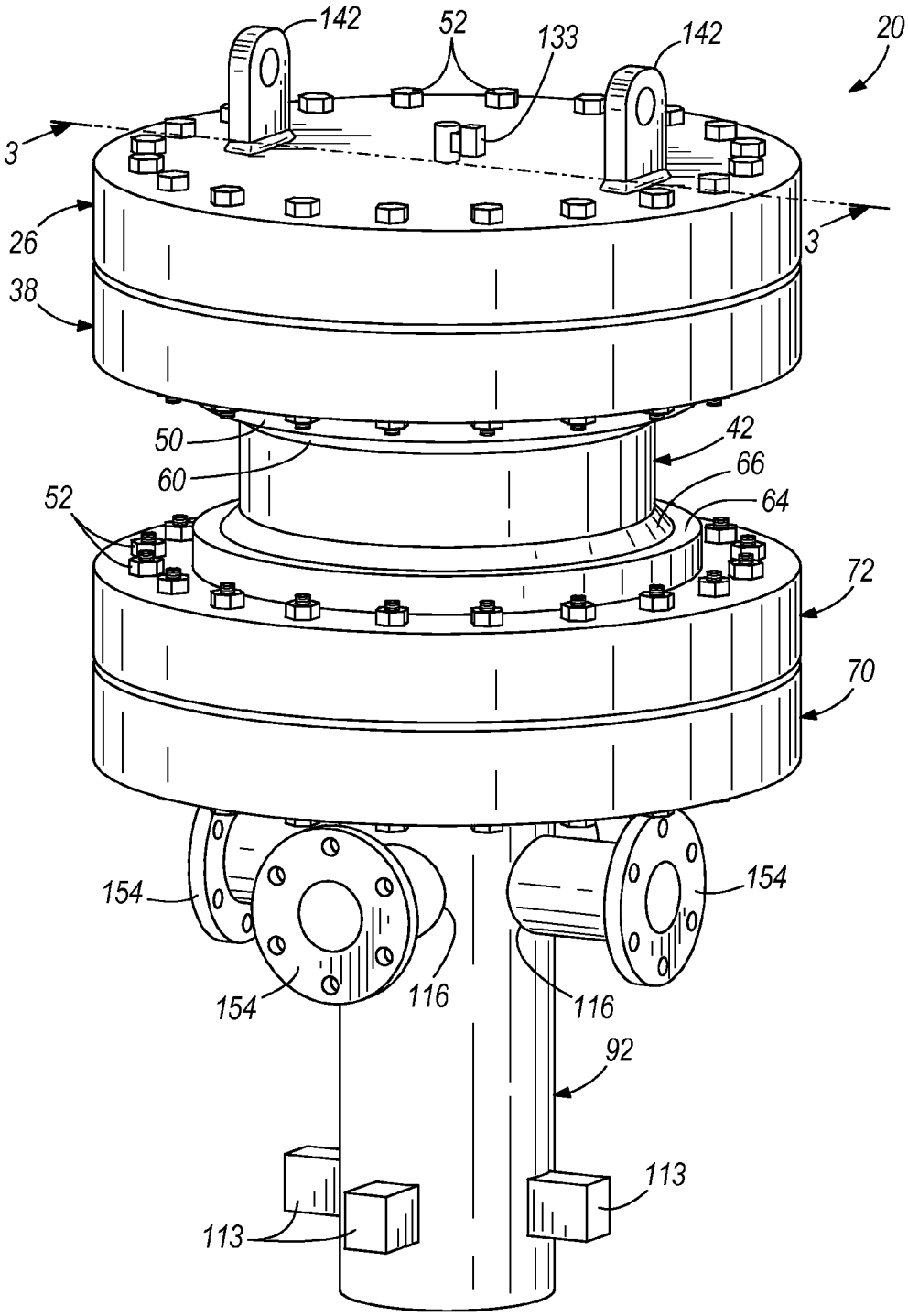
FIG. 2 is a perspective view of the pipe closing apparatus shown in FIG. 1 without a weight coupled to the pipe closing apparatus.
Figure 3:
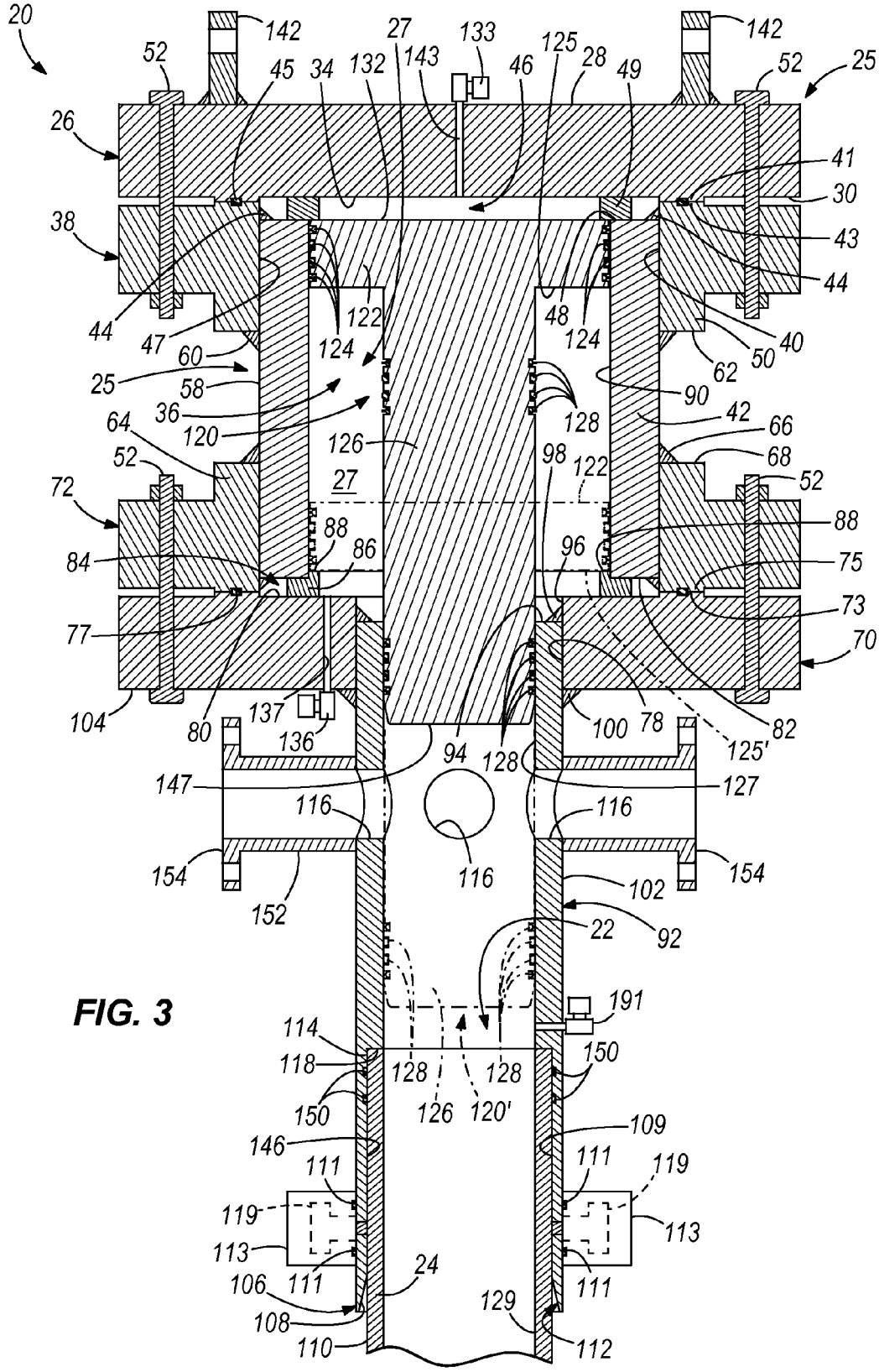
FIG. 3 is a cross-sectional view taken along line 3-3 in FIG. 2 of a pipe closing apparatus engaged with a riser pipe of an oil well, wherein a retracted position of the apparatus is shown in solid lines and an extended or sealed position of the apparatus is shown in dashed lines wherein in the extended position an arm of the apparatus blocks or closes vent openings.

With reference to FIGS. 1-3, a pipe closing apparatus 20 is shown and is capable of stopping the flow of fluid from opening 22 in riser pipe 24, wherein riser pipe 24 may have various uses, various diameters, and utilized in various environments. In some exemplary embodiments, and the one to be discussed as an example herein, riser pipe 24 may be an oil riser pipe. Oil riser pipe 24 is typically utilized in connecting an oil drilling rig platform to a portion of a well positioned near the ocean bottom or sea bed. The portion of the well positioned near the sea bed extends from riser pipe 24 beneath the ocean floor to the oil reservoir being tapped. Thus, riser pipe 24 generally extends from the ocean surface, where the drilling rig is positioned, to a portion of the oil well located near the ocean floor. In a number of instances riser pipe 24 extends from the drilling rig to a blow out preventer positioned on the ocean floor. As will be appreciated herein, apparatus 20 may be employed to close a ruptured riser pipe 24 and thereafter re-open it and harvest the oil or may also be employed as original equipment in the construction of a deep water oil drilling rig to close and re-open an operational well as needed. In this example, riser pipe 24 has been ruptured at a depth in the ocean proximate to the ocean floor. The ruptured riser pipe 24 is positioned at a depth that makes direct human contact with riser pipe 24 not reasonably possible because of substantial hydrostatic pressures at that depth. In the example discussed herein-below, opening 22 of riser pipe 24 is positioned at a depth of approximately 5000 feet in the ocean and the apparatus 20 may be configured to facilitate closing the ruptured riser pipe 24 at that depth. However, it should be understood that the riser pipe could be positioned at other depths and therefore being positioned within other hydrostatic pressure environments, as a result, and the pipe closing apparatus 20 may be constructed and sized to accommodate closing a pipe carrying a certain level of pressurized fluid such as oil by utilizing a certain ambient hydrostatic pressure of that depth in the ocean.

For purposes of describing the embodiments herein, the interior diameter of riser pipe 24 is approximately 9 inches and is typically constructed at approximately 12½% tolerance and the outside diameter of riser pipe 24 is approximately 10¾ inches, which is typically constructed at approximately a 1% tolerance. It should be understood for the purposes of this invention the diameter of the pipes to be closed may vary, as well as, the wall thicknesses of the pipe. Likewise, the depths at which opening 22 is positioned may vary, as well as, the pressure of the oil escaping opening 22 of riser pipe 24. Thus, it should be readily appreciated that depending on the size of the pipe to be closed, the forces involved environmentally with the depth of the ocean, and the pressure of the oil being leaked, the present invention may be scaled to accommodate the forces at issue for closing the particular breached opening in a given pipe.

In the present example, as mentioned above, opening 22 of riser pipe 24 has an internal diameter of approximately 9 inches and the outside diameter of the riser pipe 24 is approximately 10¾ inches. It should be understood that the numerical representations herein are exemplary for the purposes of providing an understanding of this example. Riser pipe 24, in this example, with a circular cross section, provides an approximate area of opening 22 of 63.617 square inches. At the depth of 5000 feet, the hydrostatic force being applied at opening 22 would be approximately 2227 pounds per square inch (psi) which would equate to a total force of approximately 141,675 pounds. (2227 psi (water pressure at 5000 feet)×63.617 sq inches (opening 22)=141,675 pounds). The oil well, in this example, has tapped an oil reservoir and is receiving oil from that reservoir under a pressure of approximately 2627 pounds per square inch (psi). Thus, the oil within the well is pushing in an upward direction, toward the surface of the ocean, with a force of approximately 167,122 pounds (2627 psi×63.617 sq inches (cross section area of riser pipe 24)=167,122 pounds). At the exit position of opening 22 of ruptured riser pipe 24, the net pressure of the oil exiting opening 22 into the ocean at 5000 feet of depth is the pressure differential of 2627 psi (pressure in the well)−2227 psi (hydrostatic pressure at 5000 feet) or a net 400 psi in an upward exiting direction. This net pressure equates to a total net upward exiting force of the oil of approximately (167,122 pounds (force in well exerted by the oil)−141,675 pounds (hydrostatic pressure of ocean at 5000 foot depth)=25,447 pounds of net force in a direction upward and out of opening 22.\

Closing apparatus 20, as seen in FIGS. 1-3, is an exemplary embodiment to address closing the above described opening 22 of riser pipe 24 positioned in water 5000 feet below the ocean surface wherein the net exiting oil pressure is at approximately 400 psi. It should be understood that apparatus 20 may be constructed of materials and/or coated with coatings capable of withstanding corrosion and other negative ramifications resulting from exposure of apparatus 20 to the deep ocean environment. While some exemplary materials are provided below, these exemplary materials should not be considered as limiting and apparatus is capable of being constructed of other materials and of being coated with coatings and be within the intended spirit and scope of the present invention.

In referring to FIGS. 2 and 3, this example of closing apparatus 20 includes top member 26. Top member 26 is constructed of a steel, stainless steel or of a like strong material, wherein this material may also be coated with a corrosive resistant material. The shape of this top member 26 is similar to a disk including opposing flat surfaces 28 and 30. It is well understood that the shapes dimensions of the components that comprise closing apparatus 20 may vary as needed. In this example, the disk shaped top member 26 has a diameter of approximately 41 inches and is approximately 5.5 inches thick. A portion of surface 30 of top member 26 forms a ceiling 34 of interior gap or upper chamber 46 of apparatus 20. Interior gap or upper chamber 46, for this embodiment, has a dimension of approximately 1 inch from ceiling 34 to top surface 132 of top 122 of member or piston 120. Top surface 132 forms a boundary for upper chamber 46. A second member 38 is positioned below top member 26 and coupled or fastened to top member 26. In the illustrated exemplary embodiment, an array of fasteners 52, such as bolts with nuts in this example, are used to couple members 26, 38 together.

Second member 38 is likewise constructed of a steel, stainless steel or a like strong material as is the construction of top member 26 and may be coated as mentioned for top member 26. Second member 38 will take on, in this embodiment, a generally disk shape including a hub 50 and a circular cross sectioned bore 40 positioned through a central portion of the disk shaped second member 38. The thickness of disk shaped second member 38 will similarly be approximately 5.5 inches and approximately 41 inches in diameter. In this embodiment, bore 40 formed in second member 38 may be approximately 24 inches in diameter.

Second member 38 abuts top member 26 and is fastened or secured to it. Securing top and second members 26 and 38 together may be done in a variety of manners. In this exemplary embodiment, top and second members 26 and 38 are coupled together via fasteners 52. The fasteners 52 may be a wide variety of different types of fasteners. In some examples, the fasteners 52 may include a number of bolts each having corresponding nuts. The bolts used in this example may have a 2½ inch diameter shaft and the nut may have a corresponding 2½ inch diameter opening. In some examples, twenty (20) fasteners 52 may be used to couple the top and second members 26, 38 together. Many other types of fasteners may be utilized to couple the top and second members 26, 38 together including welds.

In this embodiment, fasteners 52 comprise twenty bolt and nut combinations employed in a generally circular pattern, as seen in FIG. 2. A variety of number of fasteners may be used and placed in a variety of patterns. In this instance, the bolts are tightened sufficiently to compress top and second members 26 and 38 tightly together to form a high pressure water tight seal between them. In this example, raised faces 41 and 43 are positioned respectively on bottom of top member 26 and on top of second member 38. A gasket 45 is positioned and compressed between raised faces 41 and 43 as the fasteners are tightened to form a high pressure water tight seal between members 26 and 38. The gasket 45 can take on a variety of shapes and compositions to accommodate whatever high pressure water tight seal is needed between the outside of apparatus 20 and an interior of apparatus 20.

Closing apparatus 20 also includes cylinder tube 42, which is constructed of a steel, stainless steel or like strong material. Similarly cylinder tube 42 may be coated with corrosion preventative coating. In some exemplary embodiments, an inner surface 90 of cylinder tube 42 may be finished to provide a honed cylinder quality surface to facilitate smooth sliding and a quality seal between sealing members 124 and inner surface 90. In this embodiment sealing members are positioned around top portion 122 of piston 120 and form a high pressurized seal between upper and lower chambers 46 and 36. As will be appreciated herein, top portion 122 of piston 120 is moveable within housing 25 and sealing members 124 maintain abutting and sealing relationship with interior wall of housing 25 or inner surface 90 of cylinder tube 42, of this embodiment during such movement. In other exemplary embodiments, inner surface 90 of cylinder tube 42 may be finished in other manners that provide a smooth honed cylinder quality bore finished surface to facilitate smooth sliding and a quality seal between sealing members 124 and inner surface 90. Cylinder tube 42, in this embodiment, is approximately 22 inches long with a wall thickness that would readily resist hydrostatic pressures that would be experienced in this example at 5000 foot depths and would be approximately 3 inches or greater if so selected. Cylinder tube 42 forms an interior diameter of approximately 18 inches. As seen in FIG. 3, cylinder tube 42 is secured to second member 38 by weld 44, which is employed to secure top surface 48 of cylinder tube 42 to inner sidewall 47 of second member 38. Other known fastening devices may be employed. In this embodiment, cylinder tube 42 is positioned slightly below ceiling 34. The space between top surface 48 of cylinder tube 42 and ceiling 34, in this embodiment, is approximately 1 inch. A top stop ring 49 is snuggly positioned in this space between ceiling 34 and top surface 48 of cylinder tube 42. Top stop ring 49 is constructed of a steel, stainless steel or like strong material, is positioned firmly between top surface 48 and ceiling 34, and may be welded or otherwise coupled to either or both. A portion of top stop ring 49 extends over a portion of top 122 of piston 120 so as to limit the upward travel of piston 120 and the proximity of top 122 and top surface 132 to ceiling 34, thereby maintaining at least 1 inch spacing between ceiling 34 and top surface 132 of top 122 with piston 120 in a fully retracted position. In this illustrated exemplary embodiment, top stop ring 49 may be approximately 1 inch thick (height) and may be approximately 2 inches wide. Stop ring 49 may have an inside diameter of the interior opening of approximately 17 inches.

In this embodiment, hub 50 is unitarily formed as one-piece with second member 38 and is positioned around the outside of and in abutment with cylinder tube 42. As can be seen in FIG. 3, hub 50 is secured to cylinder tube 42 by weld 60 positioned between outside surface 58 of cylinder tube 42 and a bottom surface 62 of hub 50. Hub 50 provides additional vertical support for second member 38 and lateral support to cylinder tube 42.

In this embodiment, as seen in FIGS. 2 and 3, a very similar support structure for cylinder tube 42 is secured to a bottom portion of cylinder tube 42. Hub 64 of second bottom member 72 is positioned spaced from hub 50 approximately 8 inches along outside surface 58 of cylinder tube 42. In the illustrated exemplary embodiments, hub 64 is secured to cylinder tube 42 by weld 66 positioned between outside surface 58 of cylinder tube 42 and top surface 68 of hub 64. Alternatively, hub 64 may be secured to cylinder tube 42 in a variety of different manners. As was the case for hub 50 and second member 38, hub 64 is unitarily formed as one-piece with second bottom member 72.

In referring to FIGS. 2 and 3, second bottom member 72 is positioned between bottom member 70 and hub 50 of second member 38. Like second member 38, second bottom member 72 is similarly shaped, sized and constructed of a strong material such as steel, stainless steel or other like strong material. Like second member 38 in relationship to cylinder tube 42, second bottom member 72 snuggly fits against outside surface 58 of cylinder tube 42.

Bottom member 70 is positioned beneath second bottom member 72. Bottom member 70 has a generally disk-like configuration similar to top member 26, but unlike top member 26, bottom member 70 has a cylindrical bore 78 positioned in a central portion of the disk configuration. Bore 78 has a generally circular cross section and forms generally a cylindrical shape with a diameter of approximately 12 inches. Bottom member 70 and top member 26 are similarly constructed of a steel, stainless steel or a like strong material, as is second bottom member 72. Also these members may be coated with a corrosion prevention coating. The thickness and diameter of bottom member 70 are similar to that of top member 26 and may have a thickness of approximately 5.5 inches and an overall diameter of 41 inches. In this embodiment, the overall diameter and thickness of second bottom member 72 is similar to that of bottom member 70. Bottom member 70 and second bottom member 72 are secured or fastened together similarly as top and second members 26 and 38. Again, this fastening may be accomplished in a variety of ways such as those described above for securing top member 26 to second member 38. In this embodiment, fasteners 52 comprising nuts and corresponding bolts are used to secure bottom member 70 to second bottom member 72. Other forms of securement such as welds may be used in conjunction with or instead of the nuts and bolts. The fasteners 52 may be positioned in a number of shaped patterns such as circular as is used in this embodiment. The number of fasteners used may be twenty (20) so as to secure bottom and second bottom members 72, 70 together to withstand the forces to which apparatus 20 may be exposed. As earlier described, top and second members 26 and 38 are secured together to form a high pressure water tight seal, likewise bottom and second bottom members 70 and 72 are similarly secured together. Members 70 and 72 respectively include raised faces 73 and 75. Similarly, as described above for raised faces 41 and 43, a gasket 77 is positioned and compressed between raised faces 73 and 75 to form a highly pressurized water tight seal between raised faces 73 and 75. Fasteners 52 are tightened to compress gasket 77 between faces 73 and 75, thereby forming the high pressure water tight seal. As mentioned above, a variety of different gaskets 77 may be used to accommodate different pressures at different ocean depths.

It should be noted that with bottom member 70 secured to second bottom member 72, top surface 80 of bottom member 70 is vertically spaced apart from bottom surface 82 of cylinder tube 42, thereby forming gap 84, as seen in FIG. 3. A portion of stop ring 86 is positioned in gap 84 between bottom member 70 and cylinder tube 42 and may be secured to cylinder tube 42 and/or bottom member 70 by welding or other conventional securements. In this embodiment, the spacing between top surface 80 and bottom surface 82 is approximately 1 inch. Stop ring 86 is constructed of a strong material such as steel, stainless steel or the like strong material and may be dimensioned in a similar manner to stop ring 49 described above. Another portion of stop ring 86 is positioned outside of gap 84 and includes projection member 88, which extends in an upward direction and is positioned, in this embodiment, against inner surface 90 of cylinder tube 42. With projection member 88 positioned to engage inner surface 90 of cylinder tube 42, stop ring 86 maintains its position between bottom surface 82 of cylinder tube 42 and top surface 80 of bottom member 70. Stop ring 86 can be secured to bottom member 70 or cylinder tube 42 by welding or other conventional securement method. Stop ring 86 or other commonly known stop members may be employed to stop the downward travel of piston 120 in contacting bottom surface 125 of piston 120 (to be discussed in further detail below).

Bore 78 of bottom member 70, in this embodiment, has a diameter of approximately 12 inches to provide a snug fit for receiving riser pipe engagement cylinder 92. Riser pipe engagement cylinder 92, in this embodiment, is constructed of a strong material such as a steel, stainless steel or the like and may similarly be coated with a corrosion resistant coating. The wall thickness, in this embodiment, of engagement cylinder 92 is approximately 1.5 inches. In this embodiment, the interior diameter of 9 inches for engagement cylinder 92 matches the interior diameter of riser pipe 24. Upper surface 94 of engagement cylinder 92 is secured to inner bore surface 96 of bottom member 70 by use of weld 98. Other common ways of securing engagement cylinder 92 to bottom member 70 may be used. Additional securement of engagement cylinder 92 to bottom member 70 may be achieved by weld 100, which welds outer surface 102 of engagement cylinder 92 to an underside surface 104 of bottom member 70. With these securements, engagement cylinder 92 is centrally positioned with respect to closing apparatus 20 and projects downwardly from bottom member 70.

Engagement cylinder 92 is utilized to engage and receive therein a top portion of riser pipe 24. The cross sectional interior shape and dimension of the engagement cylinder 92 should closely match the riser pipe 24 that is to be received and contained therein. In this embodiment, engagement cylinder 92 projects at least 32 inches from underside surface 104 of bottom member 70. The leading end 106 of engagement cylinder 92 has beveled edge 108. Beveled edge 108, in this embodiment, creates an angle of about seven (7) degrees with outer surface 110 of riser pipe 24. This angle may be in a wide range of angles from about seven (7) degrees to about thirty (30) degrees. Beveled edge 108 provides ease in positioning and ultimately slipping engagement cylinder 92 over riser pipe 24. Leading end 106 of engagement cylinder 92 defines an opening 112 of a dimension larger than the outside diameter of riser pipe 24. Thus, for example, riser pipe 24 has an outside diameter of 10¾ inches and leading end 106 may have an opening of a diameter of approximately 12 inches. This would make it easier to position leading end 106 over riser pipe 24 and enclose opening 22 of riser pipe 24 within engagement cylinder 92. With a leading edge 114 of riser pipe 24 contacting beveled edge 108, beveled edge 108 may assist in centering opening 22 within engagement cylinder 92 as apparatus 20 is lowered over riser pipe 24.

Figure 10:
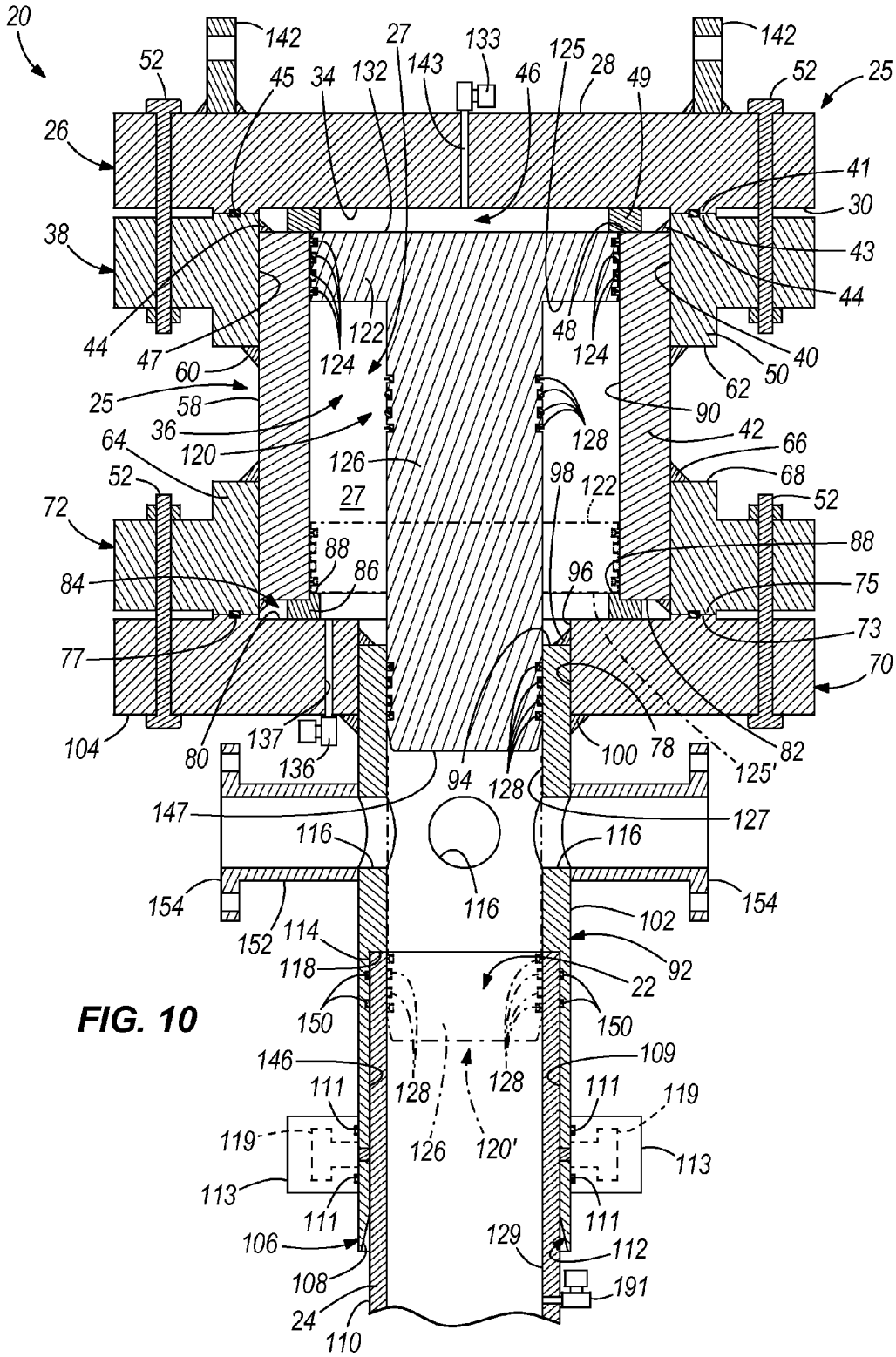
FIG. 10 is a schematic cross sectional view of an alternative embodiment of the pipe closing apparatus shown in FIG. 3, wherein a retracted position of the apparatus is shown in solid lines, an extended or sealed position is shown in dashed lines.
Figure 11:
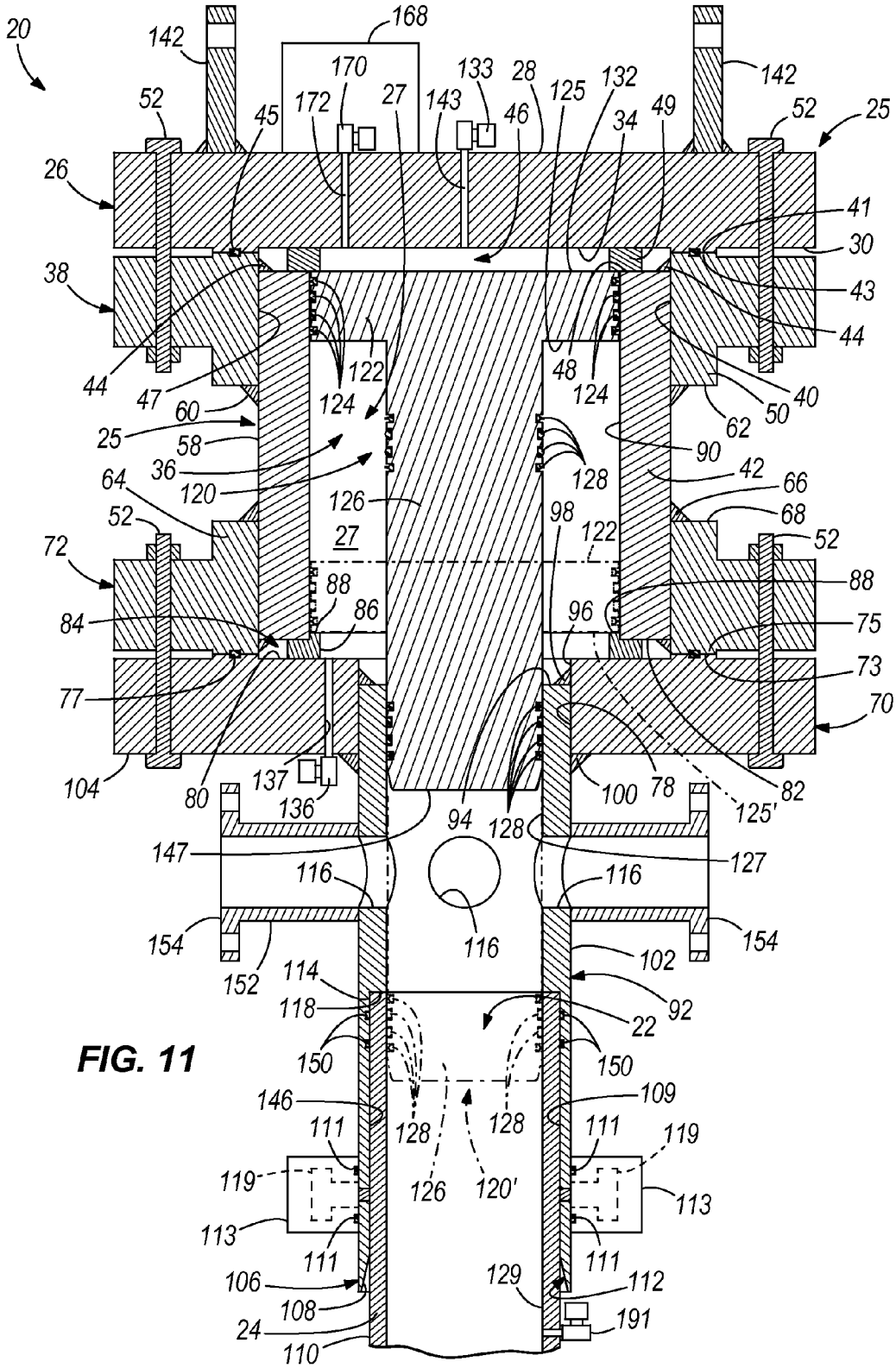
FIG. 11 is a schematic cross sectional view of the alternative embodiment of the pipe closing apparatus shown in FIG. 10 and an accumulator is shown in schematic.

In the present embodiments described in FIG. 3 and FIGS. 10 and 11, closing apparatus 20 comprises housing 25 which encloses a space or chamber 27. As can be appreciated in these embodiments, housing 25 comprises the components which create chamber 27 which includes top member 26, second member 38, cylinder tube 42, hubs 50 and 64, second bottom member 72, bottom member 70 and engagement cylinder 92. It is contemplated that in other embodiments additional or less components may be employed to construct housing 25. For example, housing 25 may have such components integrated with one another forming less in number. These components form chamber 27 and arm 126 further closes housing 25. Chamber 27 is further sealed from an external environment of housing 25 with the securement of these components, closed positions of valves 133, 136 and 170, which are discussed in more detail herein, and strategically positioned sealing members 128 position on and around arm 126 that can abut interior wall surface 127 of engagement cylinder 92 so as to maintain chamber 27 in an air and water and oil tight sealing condition regardless of the arm being in a retracted though fully deployed positions. As can be appreciated herein, top 122 of piston 120 generally divides chamber 27 into two chambers in these embodiments. These chambers include upper chamber 46 and lower chamber 36. Chambers 36 and 46 are sealed from one another with sealing members 124 positioned around top 122 which abut inner surface 90 of cylinder tube 42.

In order to successfully engage opening 22 with plugging apparatus 20 while highly pressurized oil exits opening 22, the oil escaping opening 22 must be uniformly diverted to flow away from apparatus 20. This allows engagement cylinder 92 to be positioned over riser pipe 24 and lowered downwardly over opening 22. If the escaping oil is not uniformly directed away from engagement cylinder 92, the oil pressure would tend to push apparatus 20 away from riser pipe 24, thereby making it difficult to maintain proper alignment of engagement cylinder 92 with riser pipe 24 and difficult to receive riser pipe 24.

Figure 9:
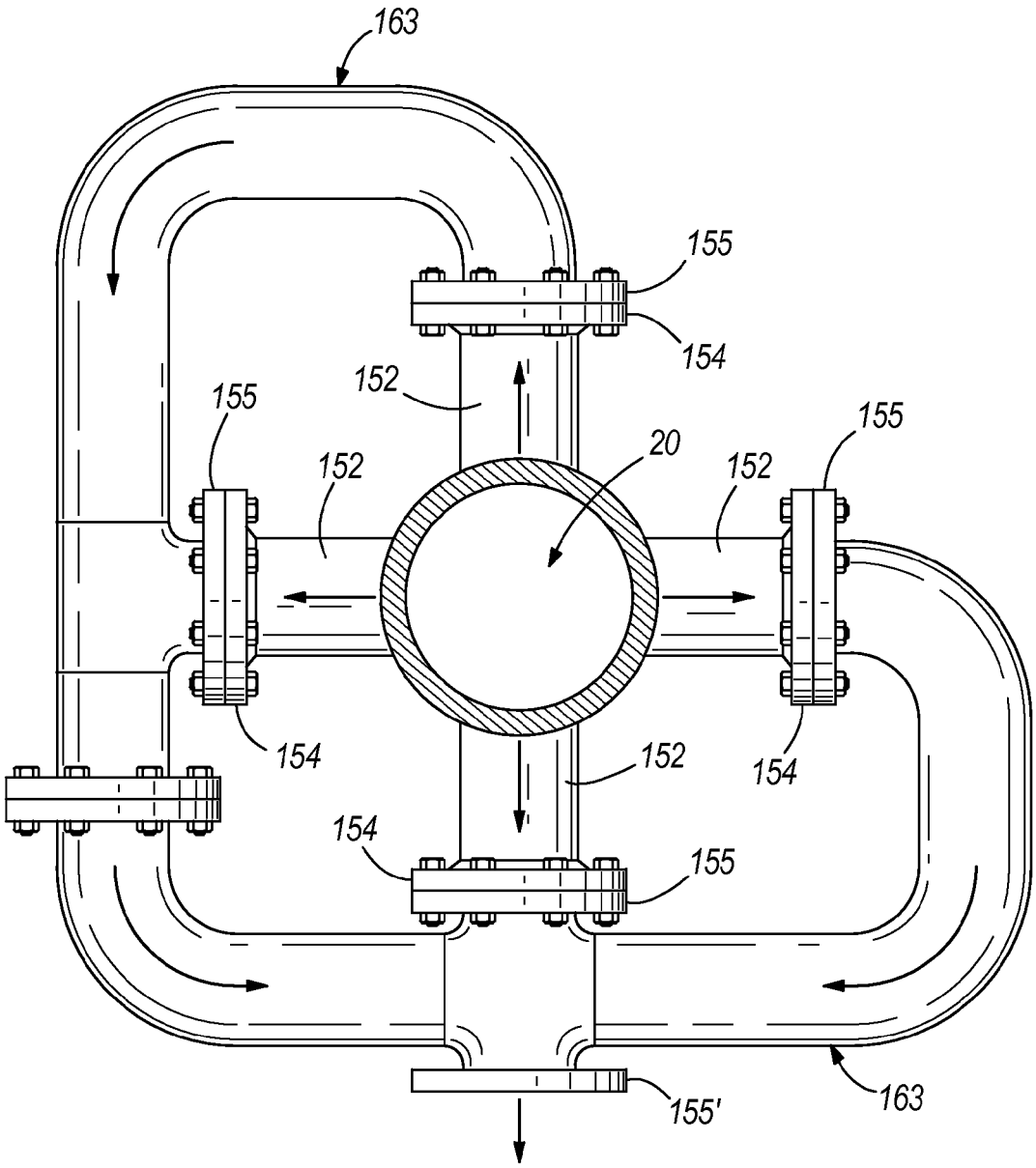
FIG. 9 is a top schematic view of a manifold connected to the pipe closing apparatus, wherein the manifold will collect oil from the oil well with the closing apparatus in the retracted position, which is illustrated in solid lines in FIG. 3.

To assist in uniformly diverting oil away from engagement cylinder 92, vent openings 116 are provided in engagement cylinder 92. In this embodiment, vent openings 116 are defined in the wall of engagement cylinder 92 and are spaced equally and symmetrically around the perimeter of engagement cylinder 92. In this embodiment, each vent opening 116 is center positioned approximately every 90 degrees around the perimeter of engagement cylinder 92. This positioning for this embodiment results in four (4) vent openings 116. Each vent opening 116, of this embodiment, may be about 4 to 6 inches in diameter. The center of each vent opening 116 may be positioned, in this embodiment, about 20 inches up from leading end 106 of engagement cylinder 92. Vent openings 116 can be accommodated with nozzles 152, as seen in FIG. 9, wherein nozzles 152 are welded or otherwise suitably connected to engagement cylinder 92 to communicate with vent openings 116 and lead oil away from vent openings 116 and closing apparatus 20. Nozzles 152 may further provide a connecting flange 154. It will be further discussed below that each nozzle 152 could be connected to their own riser pipe (not shown) for bringing the oil to the surface for collection or nozzles 152 could be connected to a manifold 163, by way of, in this example, flanges 155 being connected to flanges 154 of nozzle 152, as seen in FIG. 9. Manifold 163, in turn, is connected to a single riser pipe (not shown) wherein such riser pipe could be connected to flange 155' to carry the oil to the surface for collection. Other configurations of manifolds could be employed as, for example, manifold 184 shown in FIG. 12. In manifold 184, a section of pipe is connected to each of flanges 154 with a flange. Each pipe (four) of manifold 184 constructed to direct the flow of the oil upwardly. Each of these pipes then connect to a single riser pipe 24 similarly to the lower portion of the pipes connecting to engagement cylinder 92 with nozzles and flanges, as seen in FIGS. 3, 10 and 11. Other configurations for such manifolds are contemplated to collect oil from the well for facilitating the oil to reach a riser and carry the oil to the surface.

Figure 4:
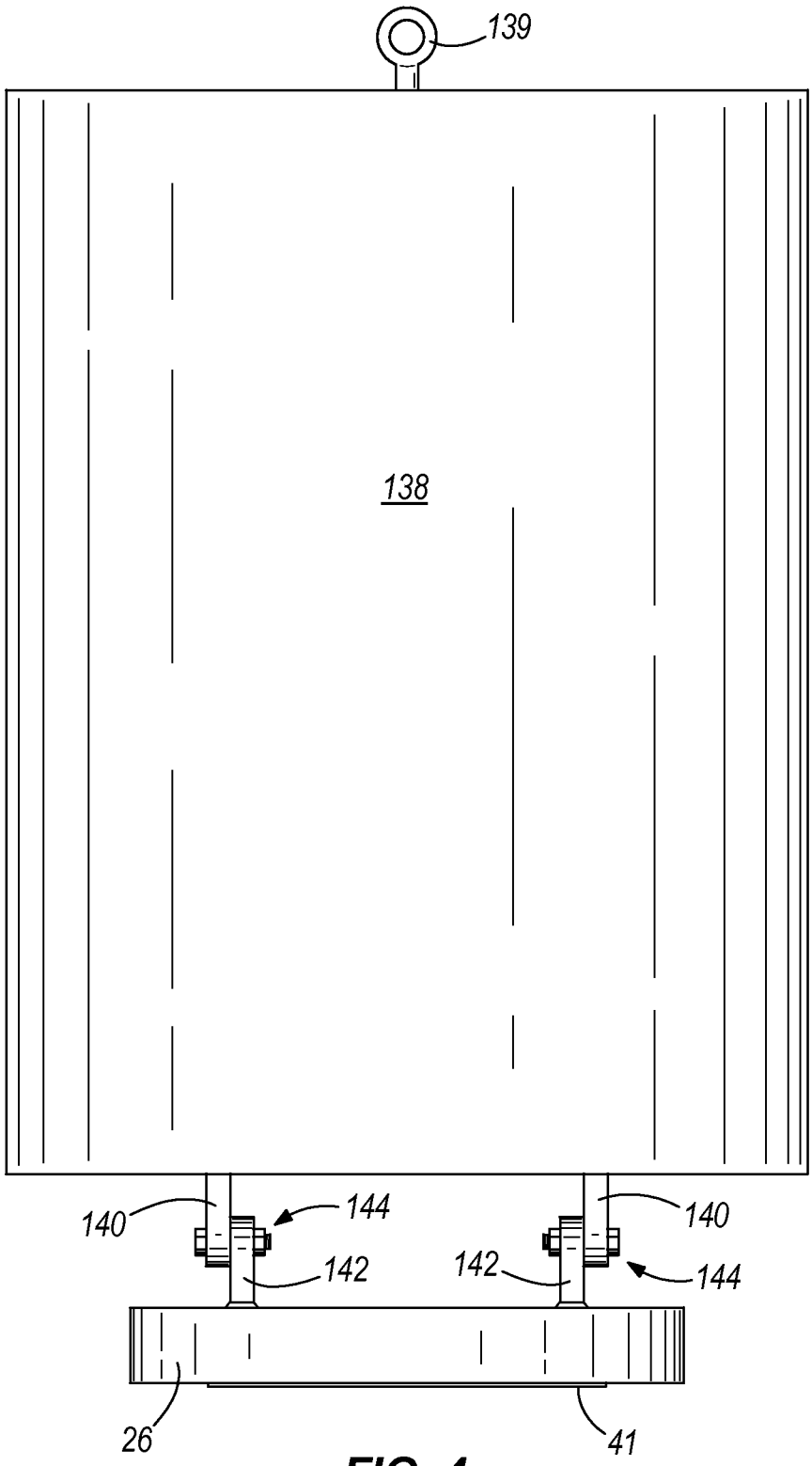
FIG. 4 is an elevation view of a weight securable to the pipe closing apparatus shown in FIG. 1.

Thus, as apparatus 20 is lowered over riser pipe 24, oil escaping opening 22 under a net 400 psi pressure, in the present example, may begin to enter the interior of engagement cylinder 92 and may then be vented out of the symmetrically positioned vent openings 116. In this example, the lowering of apparatus 20 over riser pipe 24 in order to secure apparatus 20 to riser pipe 24 is assisted with use of weight member 138, as seen in FIG. 4 and will be discussed in further detail. Symmetric positioning of the vent openings 116 about the perimeter of engagement cylinder 92 and the proper sizing of vent openings 116 results in the volume of oil entering engagement cylinder 92 escaping from engagement cylinder 92 through vent openings 116 in a substantially uniform manner. This uniform disbursement of oil from engagement cylinder 92 reduces the likelihood of creating a net horizontal force against engagement cylinder 92 in any particular direction, thereby tending to keep apparatus 20 in alignment with riser pipe 24. If a net horizontal force was realized, the engagement cylinder 92 would be propelled in a resulting direction, thereby making it difficult to maintain alignment of the engagement cylinder 92 with the riser pipe 24. Again, the size of vent openings 116 may vary to accommodate the amount and pressure of oil escaping any given opening 22.

Once apparatus 20 is positioned above riser pipe 24 and apparatus 20 is lowered to bring beveled edge 108 of engagement cylinder 92 into contact with a leading edge 114 of riser pipe 24, the oil escaping opening 22 begins to enter into engagement cylinder 92 and then passes through vent openings 116. In the lowering process of apparatus 20, submergible robotic devices may be employed for stabilizing apparatus 20 in position as it descends onto riser pipe 24. Apparatus 20 is further lowered until seat 118 positioned in engagement cylinder 92 contacts top of riser pipe 24. Seat 118, in this embodiment, is positioned approximately 24 inches above leading end 106. At this point, apparatus 20 may not be lowered any further over riser pipe 24 and closing apparatus 20 may now be fastened to riser pipe 24.

It is contemplated that different manners of securement may be used to secure engagement cylinder 92 firmly to riser pipe 24. In one embodiment, explosive bolts or pins 119 may be positioned above leading end 106 at a position where interior surface 109 of engagement cylinder 92 is substantially parallel to outer surface 110 of riser pipe 24. With apparatus 20 at its lowest position relative to riser pipe 24, explosive bolts or pins 119, secured to outer surface 102 of engagement cylinder 92, are discharged to bolt apparatus 20 to riser pipe 24. Exemplary explosive bolts or pins 119 made by Hilti Corporation or Robert Bosch Tool Corporation may be used or other known fastening devices may be used. Explosive bolt housing 113 containing explosive bolts 119 may need to have high pressure water tight seals 111 positioned about its perimeter in contact with engagement cylinder 92 so as to prevent leakage of oil from riser pipe 24 should a bolt penetrate the entire wall of riser pipe 24. It should be noted that in another embodiment of closing apparatus 20, later discussed, arm 126 of piston 120 actually penetrates opening 22 of riser pipe 24, explosive bolts 119 are positioned such that they are below the lowest point of travel of piston 120 as seen in FIG. 10. In the present embodiment, both top portion 122 and arm 126 are generally cylindrical in shape. Other regular shapes are contemplated.

Other manners of securing engagement cylinder 92 to riser pipe 24 may be utilized. For example, threaded fasteners may be driven through the engagement cylinder 92 and at least partially through the riser pipe 24 to secure the engagement cylinder 92 to the riser pipe 24. Such threaded fasteners may include a carbide tip or be made of other sufficiently strong materials to withstand forces applied thereto during driving of the threaded fasteners. The threaded fasteners may be driven in a variety of different manners including, for example, a pneumatic tool either supported on the apparatus 20 or separate from the apparatus 20. In instances where the pneumatic tool is separate from the apparatus 20, the pneumatic tool may be supported by an underwater device such as, for example, a robot.

Figure 6:
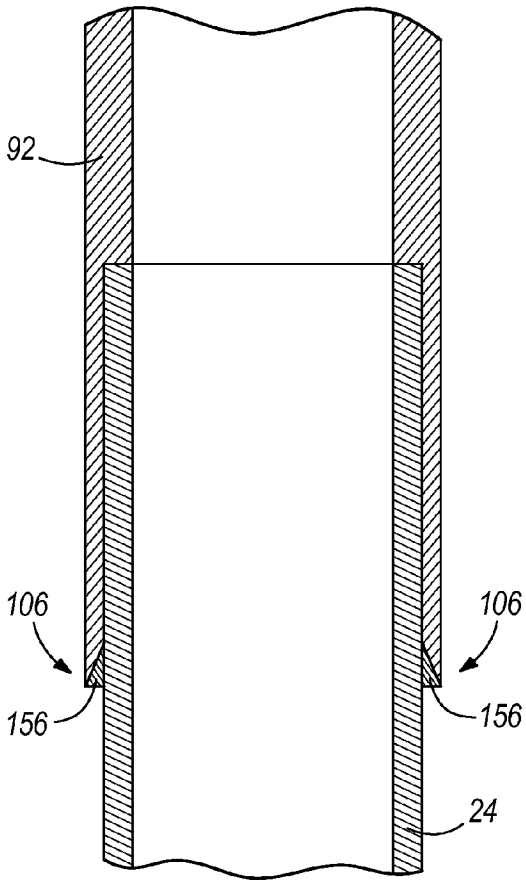
FIG. 6 is partial schematic cross sectional view taken along a vertical plane of an alternative embodiment of an engagement cylinder of the pipe closing apparatus secured to a riser pipe.

Also, for example, with reference to FIG. 6, weld 156 is applied at leading end 106 to secure leading end 106 to riser pipe 24. Weld 156 is made entirely around the riser pipe 24 and engagement cylinder 92 in order to create a water tight seal.

Figure 7:
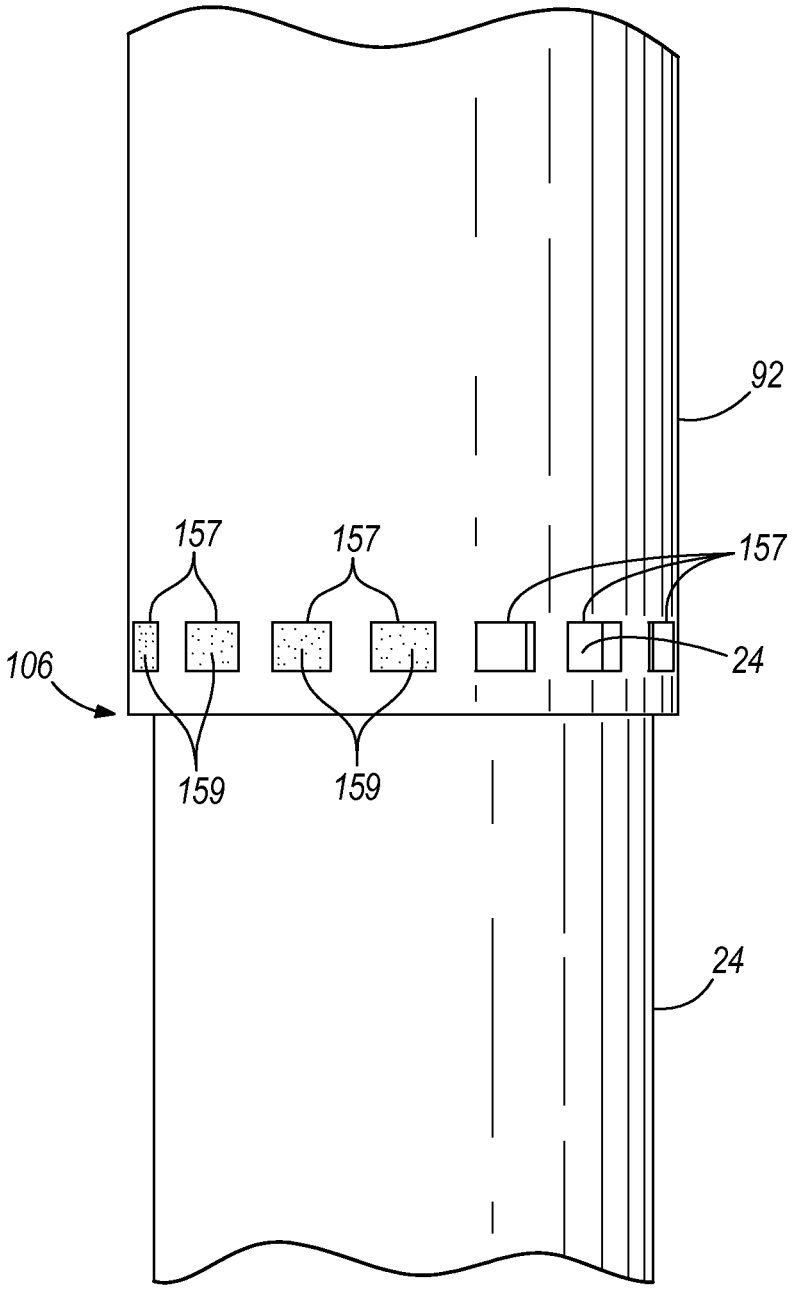
FIG. 7 is an elevation view of another alternative embodiment for securing an engagement cylinder of the pipe closing apparatus to a riser pipe.

Further, for example, with reference to FIG. 7, engagement cylinder 92 may include a plurality of apertures 157 near a leading end 106 thereof. Such apertures 157 may be intermittently disposed around the periphery of engagement cylinder 92. Apertures 157 provide locations where a weld 159 may be made to secure engagement cylinder 92 to riser pipe 24. Apertures 157 in this embodiment are rectangular in shape, however, other regular shapes are contemplated. Multiple rows of apertures 157 may be employed as well, wherein another row of apertures 157 may be positioned above the row shown in FIG. 7 such that apertures 157 in the upper row are positioned to span the gap between adjacent apertures 157 below and even overlap the adjacent apertures 157 below. An additional weld may be made entirely around riser pipe 24 and engagement cylinder 92 at the leading end 106 similarly to the weld 156 illustrated in FIG. 6. Such a weld provides a water tight seal between engagement cylinder 92 and riser pipe 24.

Figure 8:
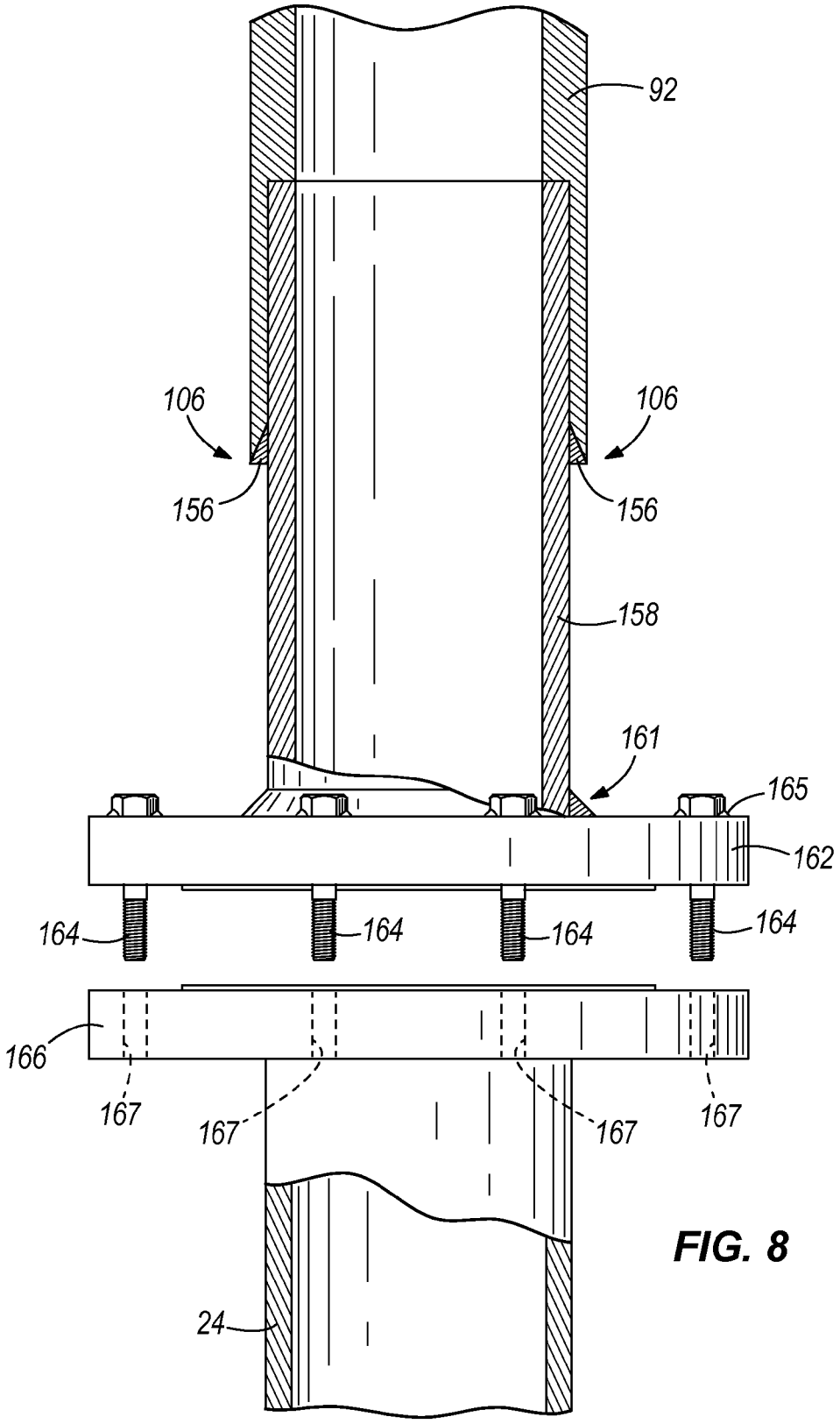
FIG. 8 is a partial schematic cross sectional view taken along a vertical plane of a further alternative embodiment for securing an engagement cylinder of the pipe closing apparatus to a riser pipe.

With reference to FIG. 8, yet another way of securing closing apparatus 20 to riser pipe 24. More particularly, an extension pipe 158 is dimensioned to closely fit the interior wall surface of engagement cylinder 92. Extension pipe 158, in this embodiment, should be dimensioned to be compatible in size with riser pipe 24, to which it will be secured. Extension pipe 158, as are the other components described in this embodiment, is constructed of a steel, stainless steel or other like strong material and may be coated with a corrosion resistant material. Extension pipe 158 is welded to engagement cylinder 92 with weld 156. In this embodiment, extension pipe 158 is welded at its opposing end to a flange 162 via weld 161. Additional welds may be employed to further secure extension pipe 158 to flange 162. Other securements may also be used to secure extension pipe 158 to flange 162. Bolts 164 are positioned within openings defined through flange 162 and are used to secure flange 162 to flange 166 of riser pipe 24. This results in securement of closing apparatus 20 to riser pipe 24. In this embodiment, bolts 164 may be welded to flange 162 with welds 165. Bolts 164 can then be inserted into openings 167 of flange 166. Flange 166 may be already positioned on riser pipe 24 or it may be secured to riser pipe 24 by conventional welding procedures. Once bolts 164 are inserted into and through openings 167, bolts 164 can then be tightened with the use of compatible nuts (not shown) to secure flanges 162 and 166 together.

Closing apparatus 20 includes piston 120, as seen in FIG. 3, which is movable between a retracted position (shown in solid lines) and an extended or sealed positioned (shown in phantom lines 120'). A portion of piston 120 moves within housing 25 and another portion of piston 120, more particularly, a portion of arm 126 moves within engagement cylinder 92. In the extended or sealed position, the piston 120' has arm 126 positioned closing vent openings 116 stopping the flow of oil from passing through and out of vent openings 116 and out of opening 22 of riser pipe 24. Piston 120 is constructed of strong material such as a steel, stainless steel or the like. In this embodiment, top 122 of piston 120 is generally disk-shaped, has a thickness of about 4.5 inches, and has a diameter of approximately 18 inches. The diameter of top 122 is very close in size to the interior diameter of cylinder tube 42, within which piston 120 travels. In this embodiment, top 122 travels within cylinder tube 42 and must maintain a high pressure water tight seal as well as high pressure gas tight seal with inner surface 90 of cylinder tube 42. A group of spaced apart gaskets or o-rings and wipers (sealing members) 124 are positioned about the perimeter of top 122 and provide the required pressurized water and gas tight fit of top 122 with inner surface 90 of cylinder tube 42. The sealing members 124 still allow top 122 to travel within cylinder tube 42 along a honed cylinder quality finished surface of inner surface 90. These sealing members 124 may be selected from a wide variety of types of sealing members and may be made of a wide variety of materials. The illustrated exemplary embodiment includes a pair of O-rings and a pair of wipers, with one wiper positioned above the pair of O-rings and one wiper positioned below the pair of O-rings. Also, in the illustrated exemplary embodiment, the O-rings and the wipers are made of a resilient material. In some embodiments, these gaskets and o-rings may be constructed of PTFE or other compatible material. In other exemplary embodiments, the gaskets and o-rings employed in this embodiment may be QC Profile made by Parker Hannifin Corporation. Other configurations for this embodiment may include quad o-rings, which would be constructed of a material such as Viton, a registered trademark of DuPont. Any such material should be made of suitable strength to seal off hydrostatic pressures exerted by great depths in the ocean. In some exemplary embodiments, the wipers may be constructed of polyurethane and may have configurations such as "U" cups. In other exemplary embodiments, the wipers utilized in this embodiment may be AH Profile Seal manufactured by Parker Hannifin Corporation. The wipers may be constructed of other materials and have other configurations, so long as they effectively provide water tight seals for the hydrostatic pressures to be applied.

Arm 126 of piston 120 is secured to top 122 and such securement may be accomplished in a number of commonly known ways such as with welds, nut and bolt fasteners, or the like. Alternatively and in the illustrated exemplary embodiment, arm 126 may be unitarily formed as one-piece with top 122. Arm 126 is generally cylindrical in shape and is constructed of a strong material such as a steel, stainless steel or like strong materials. In this embodiment, the diameter of arm 126 is approximately 9 inches so as to provide a very close fit to the interior honed cylinder quality surface 127 of engagement cylinder 92.

At an upper portion of arm 126, in this embodiment, beginning at about 4 inches below top 122, in this example, a group of sealing members 128 such as gaskets or o-rings and wipers are positioned about a perimeter of arm 126. This group of gaskets or o-rings and wipers may be similarly constructed as the group of sealing members 124 described above. All of the materials, configurations, and alternatives described above in connection with the group of sealing members 124 also apply to the group of sealing members 128 and will provide the necessary high pressure water/oil and gas tight seal.

Any number of groups of sealing members 128 may be positioned along the length of arm 126 in this embodiment. In alternative embodiments, spaced apart o-rings may be positioned along the length of arm 126. Each group of sealing members 128 may be spaced apart from each other in any increment. For example, the increment may be two or three inches and likewise for spaced apart o-rings. The appropriate spacing or positioning of multiple groups of sealing members 128 or individual o-rings along the length of arm 126 maintains at all times a high pressure water/oil and gas tight seal with interior wall surface 127 of engagement cylinder 92, thereby preventing water or oil leakage into lower chamber 36 and preventing leakage of gas or other contents out of lower chamber 36 while piston 120 moves between its retracted position (as shown in solid lines) and its a fully deployed position (as shown in phantom lines 120'). Sealing members 128 shown in FIGS. 3, 10 and 11 are merely representative and are not positioned to scale. No matter the position occupied by piston 120, groups of sealing members 128 or individual o-rings maintain a high pressure water and oil and gas tight seal for lower chamber 36. With piston 120 in its retracted position, one or more groups of sealing members 128 positioned in a lower portion of arm 126 or several spaced apart o-rings will provide a high pressure water tight and oil tight seal against interior wall surface 127 preventing any flow of fluid between lower chamber 36 and the interior of engagement cylinder 92 below arm 126. With piston 120 in its fully deployed or sealing position, wherein arm 126 covers and closes or blocks vent openings 116 thereby stopping the flow of oil out of opening 22 of riser pipe 24, sealing members 128 will provide a high pressure water/oil tight seal with interior wall surface 127 of engagement cylinder 92 both above and below vent openings 116. Sealing members 128 are positioned to seal off lower chamber 36 regardless of the position of piston 120 as well as seal vent openings 116 with arm 126 in a blocking position with respect to vent openings 116.

In some exemplary embodiments, interior wall surface 127 of engagement cylinder 92 may be finished to provide a honed cylinder quality surface to facilitate smooth sliding and a quality seal between sealing members 128 and interior wall surface 127. In other exemplary embodiments, interior wall surface 127 of engagement cylinder 92 may be finished in other manners that provide a smooth finished surface to facilitate smooth sliding and a quality seal between sealing members 128 and interior wall surface 127.

It should also be understood that an exterior surface of piston 120 may be finished to provide a smooth finished exterior surface to facilitate smooth sliding of piston 120 between retracted and extended positions. In some exemplary embodiments, the exterior surface of piston 120 may be finished to provide a honed cylinder quality surface to facilitate smooth sliding of piston between retracted and extended positions. In other exemplary embodiments, the exterior surface of piston 120 may be finished in other manners that provide a smooth finished surface to facilitate smooth sliding of piston 120 between retracted and extended positions.

In one embodiment of preparing closing apparatus 20 to be deployed from above the surface of the ocean, interior upper chamber 46, which is positioned above top 122 of piston 120, it may be preferable to put upper chamber 46 into a reduced atmospheric pressure condition. The purpose for this will become apparent from further discussions below. In the illustrated exemplary embodiment, lower chamber 36 is sealed apart from upper chamber 46 by sealing members 124 positioned around top 122 of piston 120 which in turn abut inner surface 90 of cylinder tube 42. Lower chamber 36 is sealed at a lower end of closing apparatus 20 by sealing members 128 positioned around arm 126 of piston 120 and which abuts inner surface 90 of cylinder tube 42. The sub-atmospheric pressure is achieved for upper chamber 46 by utilizing valve 133, which is in fluid communication with opening 143. Opening 143 is defined in top member 26 and is in fluid communication with upper chamber 46 and underwater environment. Valve 133 is positioned between chamber 27, and in this embodiment, upper chamber 46 and the underwater environment or exterior of housing 25. Thus, air can be pumped out of upper chamber 46 through valve 133. A reduced atmospheric pressure can be obtained by drawing air from upper chamber 46 through valve 133. Utilizing a reduced atmospheric pressure in upper chamber 46 and utilizing an atmospheric pressure in lower chamber 36 will result in a net upward force being applied to top 122 of piston 120. If there is a sufficient differential of pressures between the upper and lower chambers 46, 36 top 122 can be positioned in an abutting position with top stop ring 49 prior to the pressure differential being employed and the abutting position can be attained. For mere exemplar calculations, With an atmosphere of pressure of approximately 14.7 psi positioned within lower chamber 36 and valve 136 in a closed position and piston 120 in a fully retracted position, atmospheric pressure in upper chamber 46 can be reduced by drawing air from upper chamber 46 though valve 133 and when sufficient reduction is obtained, valve 133 can then be closed. The underside surfaces of piston 120 has approximately 254.468 square inches of surface (63.617 square inches on bottom of arm 126 and 190.851 square inches of the underside or bottom surface 125 of top 122, wherein bottom surface 125 forms a boundary for lower chamber 36). Thus, the under side surfaces of piston 120 are exposed to one atmosphere of pressure of approximately 14.7 pounds per square inch which is approximately 14.7 pounds per square inch×254.468 square inches which equals 37468 pounds of force in contrast to a near vacuum on top surface of top 122 in upper chamber 46 which has very little pressurized force placed downwardly on piston 120. With piston 120 weighing approximately 800 pounds in this example, sufficient force is available to maintain piston 120 in a retracted position prior to deploying beneath the surface of the ocean.

In this embodiment, lower chamber 36 in its ready to use state, as discussed above, has about 1 atmosphere of air pressure contained therein. In contrast, upper chamber 46 maintains a reduced atmospheric pressure to permit sufficient pressure differential with lower chamber 36 so as to maintain piston 120 in its retracted position abutting top stop ring 49. For purposes of this example and as will be discussed herein below, the hydrostatic water pressure at a depth of approximately 5000 feet will be used to move piston 120 in a downward direction within cylinder tube 42 and ultimately stop oil from escaping from opening 22 of riser pipe 24. It should also be appreciated that with piston 120 in its fully deployed position (piston 120'), piston 120' abuts stop ring 86. At this point, lower chamber 36 will have been dramatically reduced in volume to the extent, in this example, that approximately 1 inch will be the distance between the bottom surface 125 of top 122 and top surface 80 of bottom member 70. This reduced in volume size to lower chamber 36, which began under about one atmosphere, may have a pressure of approximately 18 atmospheres, in this example, or approximately 264.6 psi. This 18 atmospheres exerts approximately a force upwardly on piston 120 as follows: 190.851 square inches (surface area of the bottom surface of top 122 minus the cross sectional area of arm 126)×264.6 psi or approximately 50,499 pounds of upward force exerted on piston 120. With piston 120' resting against stop ring 86, the smaller lower chamber 36 is now bound on its top side by bottom surface 125' of top 122 of piston 120' and sealed on the bottom by groups of sealing members 128 that are engaged to interior wall surface 127 of engagement cylinder 92 positioned, in this embodiment above and below vent openings 116 (not shown).

In the present embodiment, sea water valve 133 is in fluid communication with opening 143 of top member 26, which allows valve 133 to communicate with upper chamber 46. As discussed above, opening 143 may be used to extract atmospheric air pressure from upper chamber 46 prior to deploying and utilizing closing apparatus 20. Likewise, a sea water valve 136 communicates with lower chamber 36 through opening 137 defined in bottom member 70. With the upper chamber 46 under a reduced pressure condition and lower chamber 36 under a near one atmosphere condition and both valves 133 and 136 are in a closed position, closing apparatus 20 is ready to be deployed to great ocean depths to stop oil escaping opening 22 of riser pipe 24.

In an alternative embodiment, greatly reduced atmospheric pressure or near vacuum condition can be employed to both upper chamber 46 and to lower chamber 36. The atmospheric pressure in lower chamber 36 can be reduced to near vacuum by removing air from chamber 36 through sea water valve 136, which communicates with opening 137, as was done with upper chamber 46 with sea water valve 133. Piston 120 in this embodiment may have piston 120 begin above the sea surface fully deployed. However, as closing apparatus 20 is lowered to increased depths in the ocean the hydrostatic pressure exerted on the bottom of piston 120 will soon overtake the weight of piston 120 and move piston 120 upward. With a 9 inch diameter bottom of piston 120 (63.617 square inches of surface) exposed to approximately 13 psi hydrostatic pressure (63.617×13=827 pounds), the 800 pounds of piston 120 weight will be overcome during descent. With closing apparatus 20 positioned at a depth in the ocean exerting approximately 13 psi hydrostatic pressure, the weight of piston 120 will be overcome and piston 120 will be pushed up and into engagement with stop ring 49 within closing apparatus 20.

However, before deployment of closing apparatus 20 into the depths of the ocean, a proper amount of weight must be added to apparatus 20. In the exemplary embodiment discussed herein for that embodiment, the weight of closing apparatus 20 shown in FIGS. 2 and 3 is approximately 11,000 pounds. This is insufficient weight for apparatus 20 to overcome the pressurized oil escaping from a 9 inch interior diameter riser pipe 24 at a net upward 400 psi 5000 feet below the surface of ocean. The force of the oil exiting riser pipe 24 would tend to push closing apparatus 20 away from opening 22. As discussed above, the total net force coming vertically out of opening 22 is approximately 25,447 pounds. This force would be a significant force against apparatus 20, which weighs approximately 11,000 pounds (without subtracting the buoyancy force of displaced water). Thus, to stabilize apparatus 20 proximate to and over opening 22, additional weight must be added to apparatus 20 to be able to confront and overcome the force exerted by the exiting oil.

In looking at FIGS. 1 and 4, an example of a weight member 138 is shown. Weight member 138 for the current example should weigh at least 15 tons or 30,000 pounds. The weight should be selected to provide adequate resisting weight to apparatus 20 in order to overcome the force of the outflowing oil from riser pipe 24 and facilitate lowering of apparatus 20 over riser pipe 24. As shown in the illustrated embodiment of FIGS. 1 and 4, a cylindrically shaped solid piece of steel, stainless steel or other comparable material has a diameter in this example of 48 inches and is approximately 65 inches long. An eyelet 139 is welded to a top of weight member 138. Eyelet 139 may be engaged by a hook of a crane or other suitable engagement device capable of lowering weight member 138 and apparatus 20 to the ocean floor. A pair of eyelets 140 are welded to the bottom of weight member 138 to abut and align with a pair of eyelets 142 welded to top member 26 of closing apparatus 20. With pairs of eyelets 140 and 142 aligned, bolt members 144 with nuts or other comparable fasteners may be used to firmly secure weight member 138 to closing apparatus 20. The combined weight of apparatus 20 and weight member 138 is approximately 41,000 pounds. With weight subtracted from this total for water buoyancy, the combined weight total is well in excess of the oil force being exerted at opening 22 of approximately 25,000 pounds. Additional or lesser weight may be selected to assist apparatus 20 in lowering closing apparatus 20 over riser pipe 24.

With the pressure reduced below atmospheric within upper chamber 46, lower chamber 36 under about one atmosphere of pressure or alternatively also with pressure reduced from atmospheric pressure, and weight member 138 secured to top member 26 of apparatus 20, the assembly of weight member 138 and closing apparatus 20 may now be lifted with a suitable crane utilizing eyelet 139 and lowered into the ocean. Utilizing different conventional techniques such as visual, sonar, GPS, robotic submergible devices, etc., to assist with deployment of apparatus 20, apparatus 20 may be lowered to a position just above riser pipe 24 and opening 22. Once in that position, opening 146 of engagement cylinder 92 may be aligned with riser pipe 24 using any of the conventional techniques which may include the assistance of robotic submerged devices. The crane may then lower apparatus 20 down onto riser pipe 24 allowing opening 146 to receive riser pipe 24. Oil then may begin to emerge from vent openings 116 of engagement cylinder 92. With apparatus 20 stable in this position, the crane may continue lowering apparatus 20 down until riser pipe 24 engages seat 118 of engagement cylinder 92. Once apparatus 20 is in this position, closing apparatus 20 can be secured to riser pipe 24 by a number of methods described herein. Such methods may include: explosive bolts 119; or firing ring which may be discharged to secure engagement cylinder 92 to riser pipe 24; leading end 106 of engagement cylinder 92 can be welded to riser pipe 24; and/or engagement cylinder may be bolted to a flange on a riser pipe 24. With apparatus 20 secured to riser pipe 24, oil from opening 22 continues to move through engagement cylinder 92 and escapes engagement cylinder 92 through vent openings 116 positioned in this embodiment symmetrically around the perimeter of engagement cylinder 92. It should be appreciated that positioning vent openings 116 in a symmetric fashion about the periphery of engagement cylinder 92 allows oil to escape engagement cylinder 92 in a substantially uniform fashion thereby providing stability of apparatus 20 as it is lowered over riser pipe 24. For example if two vent openings were use they would be positioned at about 180 degrees from one another on cylindrical engagement cylinder 92 and if four vent openings were used, they could be placed about every 90 degrees about the periphery of engagement cylinder 92.

Sea water valve 133 is then opened. Many known types of sea water valves may be used and in this embodiment a needle valve is employed, such as, a Swagelok Series 945 valve manufactured by Swagelok Corporation. Valve 133 in this embodiment can be adjusted to control the flow of sea water into upper chamber 46. The flow of sea water can be controlled with valve 133 to fully deploy piston 120 in any amount of time as desired, from virtually an instant to 15 minutes, or more time. Other exemplary valves may be employed to allow sea water to enter more quickly or more slowly depending on desired speed of the travel of piston 120. Sea water at approximately 2227 psi pours into upper chamber 46 exerting a force of approximately 2227 pounds per square inch on top 122 of piston 120, which has a circular top 132 of 18 inches in diameter. Mathematically, the force exerted on piston 120 is approximately 566,000 pounds of force (254.46 square inches×2227 psi=566,000 pounds) and in this embodiment will move member or piston 120. The force of the oil pressurized within riser pipe 24, in this example, is at 2627 psi or a total force of approximately 167,122 pounds of force (63.617 sq inches×2627 psi=167,122 pounds). Also, as discussed above, should lower chamber 36 begin at about one atmosphere and increases to approximately 18 atmospheres by the time piston 120 is fully deployed this increase in lower chamber 36 atmospheric pressure equates to approximately 50,499 pounds pushing upwardly on piston 120. Alternatively, if a vacuum was drawn on lower chamber 36 prior to being used, little or no atmospheric resistance will be exerted on piston 120 resisting its downward movement. Thus, the downward force exerted by seawater entering upper chamber 46 exerts a total of 566,000 pounds of force downwardly on piston 120 and this force is countered, but overcomes the upward force exerted by the oil in riser pipe 24 and the compressed air in lower chamber 36 (167,122 pounds+50,499 pounds=217,621 pounds in an upward direction). This differential in force (566,000 pounds−217,621 pounds=a net downward force on piston 120 of 348,379 pounds) shall provide a sufficient force to close vent openings 116 with arm 126 and thereby stop the flow of oil from opening 22. It should be noted that in a later described embodiment of closing apparatus 20, shown in FIGS. 10 and 11, wherein arm 126 penetrates opening 22 to plug riser pipe 24, in this embodiment making the closure of opening 22 occur more quickly toward the end of the deployment may avoid lingering of high pressurized oil escaping from opening 22 in the clearance space between arm 126 and the inner walls of riser pipe 24. This clearance space becomes smaller and smaller as arm 126 further penetrates riser pipe 24 until opening 22 is actually fully closed.

In the current embodiment of closing apparatus shown in FIG. 3, leading portion of arm 126 does not penetrate opening 22 of riser pipe 24 however, in the embodiment shown in FIGS. 10 and 11 leading portion 147 of arm 126 enters riser pipe 24 through opening 22 to the extent arm 126 is permitted to travel and closes riser pipe 24. It could be noted that in alternative embodiments, the leading portion 147 of arm 126 may be more tapered in order to make entry of leading portion 147 into riser pipe 24 easier should there be some slight deformations based on an occurrence of force or by manufacturing tolerance issue with respect to the interior diameter. to the cross sectional shape of riser pipe 24 at or near an entry location. In the embodiments shown in FIGS. 10 and 11, projection member 88 of stop ring 86 stops the travel of piston 120 with arm 126 engaged into riser pipe 24 thereby sealing opening 22 and vent openings 116.

Figure 5:
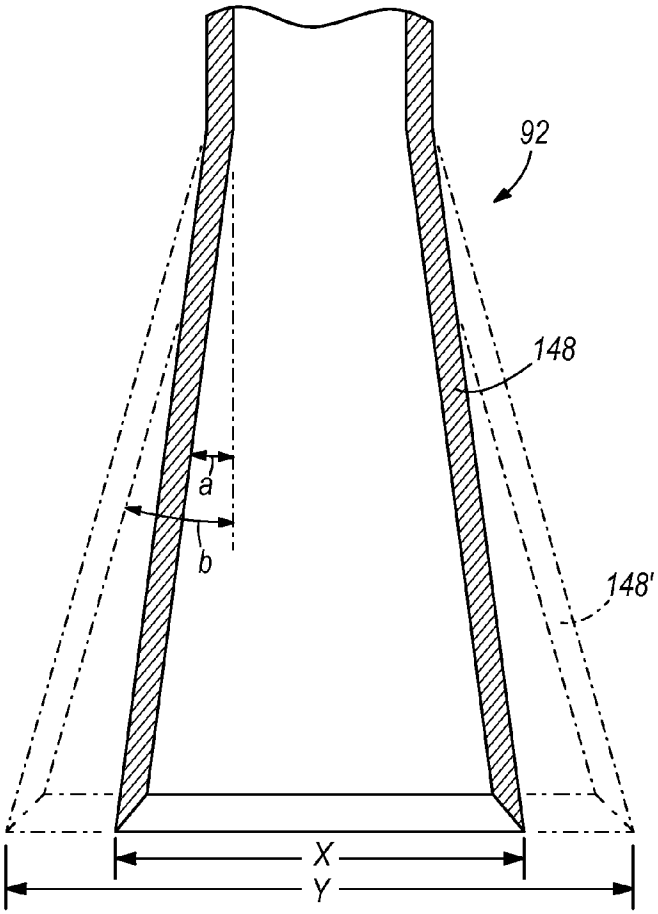
FIG. 5 is a partial schematic cross-sectional view taken along a vertical plane showing alternative embodiments for an engagement cylinder of the pipe closing apparatus shown in FIG. 3.

In looking at FIG. 5, other embodiments of the present invention are shown. In this view, two different lower portions of engagement cylinder 92 are shown. These alternative embodiments show that an opening of a lower portion of engagement cylinder 92 may be wider to make it easier to receive riser pipe 24 therein. The two alternatives are shown having angles of a and b which flare out from vertical, thereby resulting in respective opening diameters of x and y. In the solid lined drawing, configuration of walls 148 are shown opening up to an angle of approximately 7 degrees from vertical providing a circular opening with a diameter of approximately 24 inches. In the other embodiment shown in phantom, walls 148' open at an angle of 15 degrees from vertical providing an even wider circular opening of 32 inches in diameter. This generally frusto-conical configuration shows the leading portion of engagement cylinder 92 may be shaped to flare outwardly to various angles, thereby providing a wider opening to making it easier for engagement cylinder 92 to align with and cover riser pipe 24 when lowering apparatus 20 downwardly. In some instances, riser pipe 24 may not be centrally lined up perfectly with an upper portion of engagement cylinder 92 and riser pipe 24 may contact an interior surface of angled walls 148 or 148' as apparatus 20 moves in a downward direction. As closing apparatus 20 is further lowered, riser pipe 24 will be guided to a more central position within engagement cylinder 92. This position aligns opening 22 of riser pipe 24 with the opening within which piston 120 travels. Once such alignment takes place closing apparatus 20 can be secured to riser pip 24 and piston 120 can be extended in the current embodiment to close vent openings 116 and in the embodiment shown in FIGS. 10 and 11 leading portion 147 of arm 126 can be inserted into opening 22 of riser pipe 24 and closing vent openings 116.

It should be noted that in this embodiment, seal members 150, as seen in FIG. 3, are capable of sealing off high pressurized water and are positioned about an interior surface 109 of engagement cylinder 92. Seal members 150 may be similarly constructed to sealing members 124, 128 described above used in conjunction with piston 120. The positioning of these seal members 150 below seat 118 will inhibit leakage of high pressurized oil, which may be contained within riser pipe 24 and engagement cylinder prior to and during deployment of arm 126 to stop the flow of oil by closing vent openings 116 or in the instance of the alternative embodiment shown in FIGS. 10 and 11 by plugging opening 22 and closing vent openings 116.

It should be further noted that once arm 126 blocks vent openings 116 as shown in FIG. 3, or in the embodiment shown in FIGS. 10 and 11, wherein arm 126 is also inserted into opening 22, arm 126 is in position and may be retracted when desired. In the embodiment of FIG. 3, the retraction will remove arm 126 from blocking vent openings 116 thereby opening vent openings 116. In embodiment shown in FIGS. 10 and 11, retraction of arm 126 will remove arm 126 from closing opening 22 of riser pipe 24 and unblocking vent openings 116. The retraction of piston 120 allows the oil from riser pipe 24 to be harvested by it flowing through vent openings 116 and ultimately through a riser to the surface. Raising piston 120 from an extended position to a retracted position is accomplished with sea water valve 136 positioned to communicate with a now reduced sized interior lower chamber 36 with piston 120' fully deployed. Sea water valve 136 can be as those described earlier for sea water valves 133. With opening of sea water valve 136, high pressured sea water may now be allowed to fill the reduced sized interior lower chamber 36. This sea water at a depth of 5000 feet exerts approximately 2227 psi. To facilitate the retraction of piston 120, valve 133 needs to be in an opened position at this time to allow sea water to begin escaping upper chamber 46 as piston 120. With both valves 133 and 136 in an opened position piston 120 begins movement toward its upper or retracted position. With the filling of the reduced sized interior lower chamber 36, hydrostatic pressure of 2227 psi is exerted onto underside surface of top 122 of piston 120. The surface area of bottom surface 125 of top 122 of piston 120 will be the surface areas of what would be that of top surface 132 of top 122 (254.468 sq inches) minus the cross section area of arm 126 (63.617 sq inches)=190.851 sq inches. The total force exerted in an upward direction on piston 120 from the reduced in size lower chamber 36 is 2227 psi×190.851 sq inches=425,025 pounds of force in an upward direction. The pressurized oil is exerting an upward force, in this example, of 63.617 sq inches×2627 psi=167,121 pounds. Thus, the total upward force being exerted on piston 120 is 425,025+167,121=592,146 pounds of force. The downward force on piston 120 includes the hydrostatic pressure and the weight of piston 120 (with a correction on the weight for buoyancy). The sea water hydrostatic force pushing downward on top surface 132 of top 122 is 2227 psi×254.486 sq inches=566,740 pounds. The weight of piston 120, in this embodiment, is approximately 800 pounds. Thus, the total force exerted on piston 120 is a net 24,606 pounds in an upward direction (upward force of (592,146 pounds) minus downward force (566,740 (hydrostatic)+800 pounds (weight of piston 120))=net upward force of 24,606 pounds). This net upward force of 24,606 pounds will provide force to assist moving piston 120 back toward a retracted position so long as valve 133 is opened in top member 26 to allow sea water to be pushed out of upper chamber 46. Alternatively, additional openings and corresponding valves may be positioned in top member 26 to allow sea water to be removed from upper chamber 46. As piston 120 moves upward, arm 126 unblocks vent openings 116 in the embodiment shown in FIG. 3 and removes itself from within opening 22 of riser pipe 24 and unblocks vent openings 116 in the embodiment shown in FIGS. 10 and 11. Piston 120 will travel to the extent that piston 120 contacts and abuts top stop ring 49. With piston 120 positioned against top stop ring 49, piston 120 is in a retracted position. With piston 120 in its retracted position, arm 126 of piston 120 has retracted beyond vent openings 116, thereby opening vent openings 116 and permitting oil from riser pipe 24 to flow out of vent openings 116 and ultimately into a riser pipe to the surface.

Figure 12:
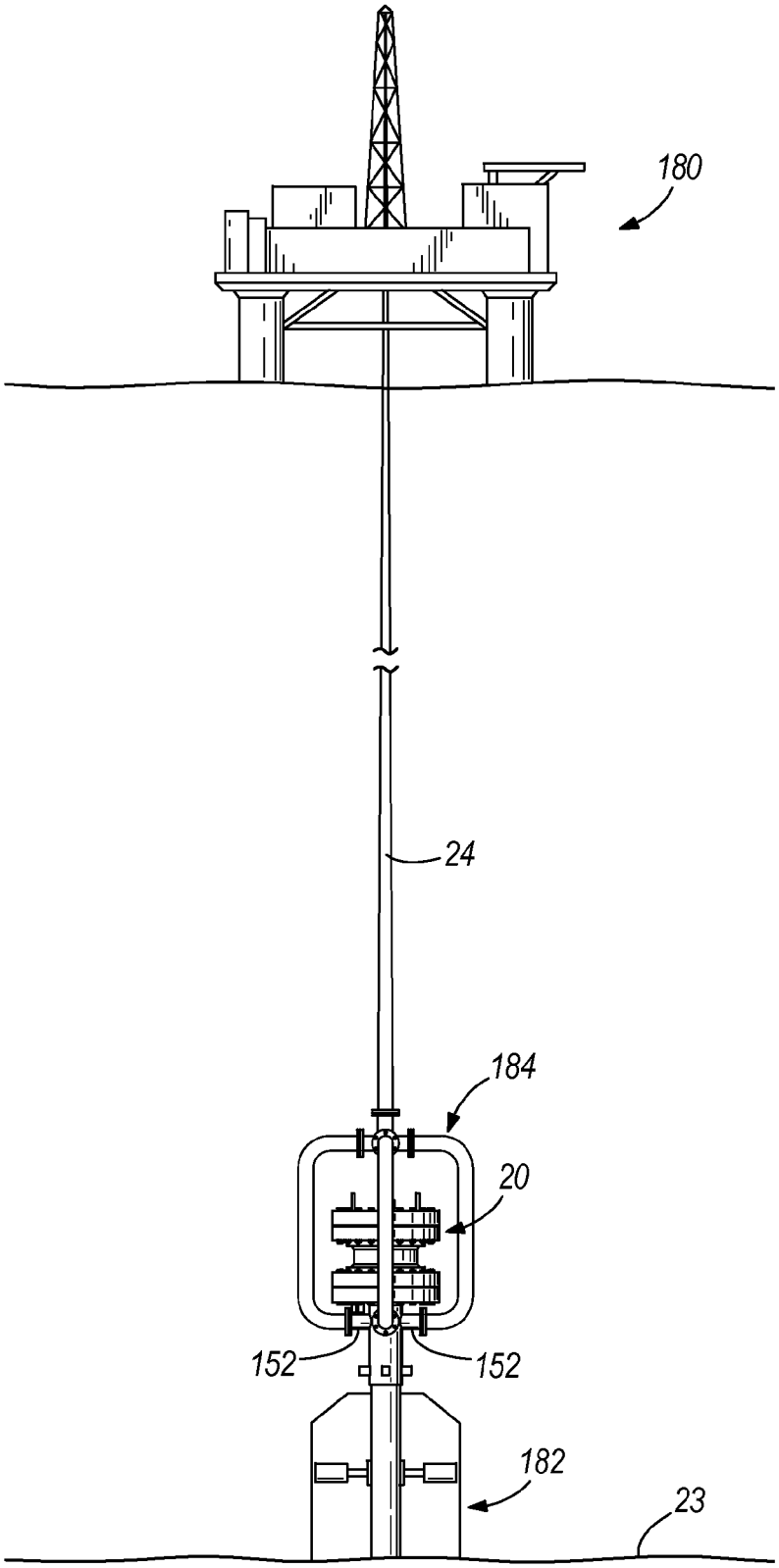
FIG. 12 is a schematic view of a deep water oil platform with a pipe closing apparatus of the present invention connected to a riser pipe above a blow out preventer.

Prior to retracting piston 120 or even prior to deployment of apparatus 20 into the ocean, vent openings 116 can be fitted with nozzles 152 and flanges 154. With piston 120 in an extended position blocking oil from exiting vent openings 116 in either embodiment shown in FIG. 3 on the one hand and FIGS. 10 and 11 on the other hand, each of nozzles 152 may then be connected to riser pipes via flanges 154. Upon connection of the risers to flanges 154, the piston 120 may be moved to its retracted position to enable oil harvesting through vent openings 116. Alternatively, as illustrated in FIGS. 9 and 12, nozzles 152 may be connected via flanges 154 to a manifold of pipes such as 163 or 184 that connect to a riser pipe 24 to bring oil to the surface. Such manifold may be coupled to apparatus 20 prior to deployment of apparatus 20 into the ocean or subsequent to plugging riser pipe 24 with piston 120. Ultimately, as will be discussed below, oil from the well will be fully harvested and collected at the surface with each nozzle 152 connected to its own riser pipe or nozzles 152 connected to a manifold 163, which is connected to a riser pipe. Each nozzle 152, in another embodiment, may also be connected to its own riser to carry the oil to the surface. As earlier discussed, in the current example being described, with sea valves 133 and 136 opened and the exiting oil pressure is at 2627 psi the net force on this approximately 800 pound piston 120 is approximately 24,606 pounds in an upward direction. This condition will keep piston 120 in a retracted position. So long as the exiting oil pressure is maintained such that it overcomes the downward force of the hydrostatic pressure being exerted on top 122 of piston 120 and the weight of piston 120, piston 120 will stay in the retracted position.

With piston 120 retracted and oil from riser pipe 24 being collected from the well, a reason may arise in the future to re-close the well. In order to now re-close the well, an accumulator 168, as seen schematically in FIG. 10, may be used with closing apparatus 20 for either embodiment shown in FIG. 3 and FIGS. 10 and 11. Accumulator 168 is in fluid communication with upper chamber 46. In any of these embodiments, accumulator 168 would be connected to another valve 170, as shown for example in FIG. 11, and, in turn, valve 170 which is in fluid communication with upper chamber 46 by way of being connected to another opening 172 positioned through and defined by top member 26.

Accumulators are well known devices that store energy and come in various configurations such as piston or bladder accumulators. For purposes of this embodiment, the capacity of accumulator is at least 19 gallons for filling upper chamber 46 with piston 120 deployed and storing that 19 gallon capacity under at least 2600 psi.

Thus, to re-close either of the embodiments of FIG. 3 and FIGS. 10 and 11 of closing apparatus and stop the flow of oil from riser pipe 24, sea valve 133 would be placed in a closed position and sea valve 136 would be placed into an open position. In referring to FIG. 11, opening 172 is provided into upper chamber 46 with a sea valve 170 connected thereto and permitting opening 172 to open or close. Valve 170 may be of a construction as earlier discussed for sea valves 133 and 136. Opening 172 and valve 170 may be provided in other embodiments such as shown in FIGS. 3 and 10. Valve 170 would be opened and accumulator 168 would be discharged into upper chamber 46 of either of these embodiments of closing apparatus 20 shown in FIGS. 3 and 10. The internal pressure of upper chamber 46 would then be pressurized to approximately 2600 psi which would exert a downward force on top surface 132 of top 122 of piston 120 of approximately 661, 619 pounds (254.469 square inches×2600 psi=661,619 pounds). This 661,619 pounds of downward force would move piston 120 back to its deployed or sealing position, thereby closing vent openings 116 in the embodiment shown in FIG. 3 and closing opening 22 of riser pipe 24 and closing vent openings 116 in the other embodiment shown in FIG. 10, thereby stopping the flow of oil out of riser pipe 24. As piston 120 moves downward from its retracted position, water in lower chamber 36 will be evacuated through yet another opening 137 and opened valve 136. As is readily understood, opening 137 is defined in bottom member 70 and is in fluid communication with lower chamber 36 and underwater environment and valve 136 is in fluid communication with opening 137 and is positioned between underwater environment and upper chamber 46. It should be noted that valve 170 can be similar to those sea valves for 133 and 136 and can be adjusted much like valve 133 or 136, as described above, such that the discharge of accumulator 168 can be controlled to control the speed of piston 120 being redeployed. With the accumulator discharged, piston 120' is again resting on lower stop ring 86.

In order to return piston 120 into a retracted position, valve 133 could be opened allowing upper chamber 46 to go back down to the water environment pressure of 2227 psi and should the oil pressure within riser pipe 24 be at 2627 psi, piston 120 would be retracted. In an instance where there is not sufficient oil pressure within riser pipe 24 to raise piston 120, an accumulator could be secured to sea valve 136 and a pressurized fluid from the accumulator can be injected into lower chamber 36 to raise piston 120.

Other methods to re-raise and re-lower piston 120 to and from a retracted and deployed positions. For example, with piston 120 deployed for the first time and upper chamber 46 is filled with water from the environment, a pump may be attached to sea valve 133 to evacuate sea water in upper chamber 46 and should additional force be needed to raise piston 120, sea water from the fluid environment could be allowed to pass through opening 137 through valve 136 to enter lower chamber 36 to apply an upward force onto piston top 122. Similarly to reclose piston 120, a pump could be secured to sea valve 136 to pump out the sea water out of lower chamber 36 and should additional force be needed valve 133 can be opened to allow sea water into upper chamber 46 to push piston 120 in a downward direction.

The above processes can be repeated to raise and lower piston 120 as desired and thereby open and close the oil well when desired. For instance, to re-raise piston 120 valve 136 and valve 133 can be opened, and if sufficient force is applied by the pressure of the oil in riser pipe 24, piston 120 will again move to a retracted position. However, should additional upward force be needed to retract piston 120, valve 136 may be connected to an accumulator to provide needed additional force to raise piston 120 while valve 133 is in an open position to let sea water out of upper chamber 46. This re-raising process can be employed for any of the embodiments. It would be recommended that a back up accumulator should be made available in a charged state for replacing the discharged accumulator with every time piston is pushed downward to re-close the well after the first closure. Similarly, a back up accumulator may be kept on hand that could be secured to valve 136 to re-open the well by raising piston 120, if needed.

Aside from using hydrostatic pressure from the sea water or an accumulator, there are other sources of energy to apply force to piston 120 for moving it in an upward or downward direction. For instance, should the oil pressure within riser pipe 24 be sufficient, that oil pressure can be tapped from the well and injected into lower chamber 36 or upper chamber 46 for moving piston 120. This can be made possible by placing a hole in engagement cylinder 92, such that when engagement cylinder 92 is engaged with riser pipe 24 and oil is moving through engagement cylinder 92 and out of vent openings 116, a hole can be made in the embodiment shown in FIGS. 10 and 11 in riser pipe 24, for example, such that it is positioned below piston 120' in its extended position. The hole may be hot tapped and a valve 191 secured to that opening This valve 191 can then be used to control the flow of pressurized oil out of riser pipe 24. The oil flow out of this valve 191 could be used to assist in opening or retracting piston 120 from a deployed position. The oil can be transported from valve 191 through piping to valve 136, where a T-valve associated with valve 136 could be positioned to allow the operator to either inject sea water hydrostatic pressure or oil pressure through valve 136. A similar arrangement could be constructed for valve 133 wherein valve 133 could operate with either sea water pressure or oil pressure from the well utilizing a T-valve associated with valve 133. If both valves 133 and 136 can be operated with either sea water pressure or oil pressure, a third T-valve could be positioned between valve 191 that is positioned at the aligned holes of the engagement cylinder 92 and the T-valves associated with valves 133 and 136. Alternatively, for embodiment shown in FIG. 3, an opening may be tapped into engagement cylinder 92 below the position to which piston 120' travels. With a valve such as 191 positioned in that tapped opening for this embodiment, a similar arrangement of T-valves can be used, as described for the embodiment shown in FIGS. 10 and 11, with sea valves 133 and 136 to supply either of upper chamber 46 or lower chamber 36 of pressurized oil of pressurized sea water. A T-valve would also be positioned between valve 191 and valves 133 and 136 thereby controlling which of valves 133 and 136 would receive pressurized oil. Because valves 133 and 136 can be T-valves, they can either supply pressurized sea water or pressurized oil for pressurizing chambers 36 and 46.

The above description of closing apparatus 20 identifies two positions for the piston 120. More particularly, the piston 120 is movable between a retracted position 120 (shown in solid lines in FIG. 3) and an extended or sealed position 120' (shown in phantom lines 120' in FIG. 3). This is also true for the embodiment shown in FIGS. 10 and 11, wherein a retracted position for piston 120 is in solid lines and a deployed or extended position is dashed lines for piston 120' which is inserted into opening 22 to close riser pipe 24. It should be understood that piston 120 may also include a third intermediate position between the retracted position and the extended position. In the instance of the embodiment shown in FIGS. 10 and 11, opening 22 of riser pipe 24 has been deformed or because of tolerance issues for interior diameter manufacturing and full deployment and inserting the leading portion 147 of arm 126 into riser pipe 24 is not possible. An intermediate position would position leading portion 147 of piston 120 and leading sealing members 128 below vent openings 116, but above opening 22 in riser pipe 24. Thus, the embodiment in FIGS. 10 and 11 would function much like the embodiment of FIG. 3. Piston 120 is not inserted into opening 22 in riser pipe 24 in this intermediate position. However, piston 120 still prevents oil from escaping from riser pipe 24 because piston 120 blocks or seals vent openings 116, which prior to blocking were the locations in the closing apparatus 20 where oil was escaping. With piston 120 in the intermediate position, oil is contained below the leading portion 147 of piston 120. Piston 120 may either be maintained in this intermediate position or may be moved further downward into its extended position. Either position may prevent oil from escaping riser pipe 24. Thus, this intermediate position for piston 120 in the embodiment shown in FIGS. 10 and 11 would have this embodiment function much like the embodiment shown in FIG. 3 where piston 120 does not reach riser pipe 24.

Piston 120 may be held or maintained in the intermediate position in a variety of different manners. In one exemplary embodiment, pressures in chambers 36 and 46 may be respectively regulated with valves 133, 136 to maintain piston 120 in the intermediate position. In this exemplary embodiment, the pressures may be controlled with great variability, thereby enabling piston 120 to be stopped or maintained at substantially any position between the retracted and extended positions. In another exemplary embodiment, one or more movable stop members may be incorporated into apparatus 20 to physically engage piston 120 and stop piston 120 in the intermediate position. Such movable stop members may be located in a variety of different locations. For example, the one or more stops may be located in an interior of engagement cylinder 92 and be movable into and out of the path of leading portion 147 of piston 120. Alternatively and also for example, the one or more stops may be located in an interior of cylinder tube 42 and movable into and out of the path of top 122 of piston 120. Movable stop members may also have a variety of different configurations. For example, apparatus 20 may include one stop member or apparatus 20 may include multiple stop members disposed around a periphery of the cylinder tube 42, the engagement cylinder 92, or both the cylinder tube 42 and engagement cylinder 92. Also, for example, the one or more stop members may be a spring biased stop member receivable in one or more cavities. Such one or more spring biased stop members may be disposed on either piston 120 or on one of cylinder tube 42 or engagement cylinder 92, and the one or more cavities may be defined in the other of piston 120 or one of cylinder tube 42 or engagement cylinder 92. Further for example, the one or more stop members may simply extend into the path of the piston 120 and engage some portion of piston 120 to block its further movement. Further yet for example, apparatus 20 may include a sensor that determines the position of piston 120 and communicates electronically with one or more movable stop members to extend to a blocking position to maintain piston 120 in the intermediate position. It should be understood that these exemplary embodiments of one or more stop members for maintaining piston 120 in an intermediate position are not intended to be limiting and other configurations of one or more stop members are possible and are intended to be within the spirit and scope of the present invention.

In an instance where riser pipe 24 has been deformed such that exterior perimeter of riser pipe 24 is no longer circular, the user may wish for a more circular configuration of riser pipe 24 in order to more easily secure apparatus 20 to riser pipe 24 or should the user wish to use the embodiment of apparatus 20 shown in FIGS. 10 and 11 wherein piston 120 is inserted into opening 22. One option would include robotically cutting riser pipe 24 at a position on riser pipe 24 where the perimeter forms a circle and thus engagement cylinder 92 can readily engage riser pipe 24.

Another option may include utilizing the embodiment of apparatus 20 shown in FIG. 3 wherein piston 120 stops the flow of oil by closing vent openings 116 and does not need to be inserted into opening 22 of riser pipe 24. Yet another alternative, should apparatus 20 conform to embodiment shown in FIGS. 10 and 11, the user could move piston 120 to an intermediate position wherein piston stops the flow of oil from opening 22 with closing vent openings 116 without needing to try to fit piston 120 into a deformed opening 22 of riser pipe 24 thereby containing the oil with leading portion 147 of piston 120 and blocking vent openings 116.

A further option is to provide at least a portion of engagement cylinder 92 with a similar configuration or enlarged in strategic directions to the deformed riser pipe 24 that would allow the riser pipe 24 to insert into engagement cylinder 92. Once engagement cylinder 92 has engaged riser pipe 24, the bottom portion of engagement cylinder 92, which could be constructed in one embodiment to engage a non-deformed portion of riser pipe 24, may be welded to and about the perimeter of riser pipe 24. This weld will close any gaps and create a high pressure seal securement between engagement cylinder 92 and riser pipe 24. With engagement cylinder 92 welded to riser pipe 24, oil flows into engagement cylinder 92 and out of vent openings 116. Closing apparatus 20, such as in the embodiment shown in FIGS. 10 and 11, could be provided with a stop ring 86, which projects upwardly along the inside of cylinder tube 42 to an elevation within lower chamber 36 such that piston 120 is restricted on how far down it can travel when it is being deployed to stop oil leaking from riser pipe 24. Such a stop ring 86 would be positioned such that when top 122 rests on stop ring 86, the bottom of arm 126 is positioned below vent openings 116 with sealing members 128 positioned against the interior wall of engagement cylinder 92 and positioned above and below vent openings 116. Thus, in this position in this embodiment, arm 126 does not have to penetrate or insert into riser pipe 24, but rather is positioned low enough to close vent openings 116 and seal the high pressured oil within the engagement cylinder 92. This embodiment will accommodate non-symmetric or deformed riser pipes 24 that may have been deformed for a variety of reasons such as, for example, an explosive force or a bend and break scenario. Apparatus 20 as shown in FIGS. 10 and 11 so modified with a taller stop ring 86 be opened or closed as desired, except arm 126 will not be inserted into riser pipe 24 and arm 126 will seal and trap the pressurized oil within engagement cylinder 92 before it can reach vent openings 116 and thereby function much like apparatus 20 of FIG. 3.

While the prior description relates to retrofitting apparatus 20 to a ruptured riser pipe 24, as seen in FIG. 1, closing apparatus 20 may be alternatively coupled to the riser pipe 24 upon initial construction of the oil well, as schematically shown in FIG. 12. In FIG. 12, oil rig platform 180 is shown in a position above the ocean surface with riser pipe 24 extending downward toward the ocean floor. Apparatus 20, in this example, is positioned between the oil rig platform 180 and blow out preventer 182. Apparatus 20 can be employed to open and close the well as desired by deploying arm 126 to block vent openings 116, thereby blocking oil from being guided through manifold 184 to riser pipe 24 and up to the surface. In this configuration, blow out preventer 182 can be used as a last effort to permanently close the well if needed. Otherwise, apparatus 20 can be used to open and close the well as desired as described above. In another embodiment, closing apparatus 20 can be positioned below blow out preventer 182 and provide the same function as it would if positioned above the blow out preventer 182. Apparatus 20 provides the oil rig operator the ability to open and close the well as desired without permanently closing the well. In addition, the apparatus 20 can be used should the blow out preventer 182 fail to close the well.

It should be appreciated that various sized cross sections of arms 126 may be employed to accommodate variations in dimensions of engagement cylinders 92 and riser pipes 24. Also, it should be appreciated that the surface area of top 122 of piston 120 may be varied to establish the required force using hydrostatic pressure or an accumulator to close or open the particular well. Variations in particular dimensions of the piston 120 will be applied with other forces taken into account such as the depth location of the well and the oil pressure within the well.

With respect to FIGS. 10 and 11, as can be appreciated from the description herein, this embodiment is constructed similarly, containing common reference numbers, to that embodiment set forth in FIG. 3, except that piston 120 of FIG. 3 does not enter into riser pipe 24 and plug the riser pipe but rather stops the flow of oil from opening 22 of riser pipe 24 to vent openings 116, in contrast to the embodiment in FIGS. 10 and 11 wherein piston 120 enters riser pipe 24 and plugs riser pipe 24 from oil flowing out of it.

In the exemplary closing apparatus 20 illustrated in FIGS. 10 and 11 has a similar construction as the embodiment described for FIG. 3 and therefore carries common reference numbers. However, in this embodiment engagement cylinder 92 is typically constructed shorter than engagement cylinder 92 of closing apparatus 20 illustrated in FIG. 3. Accordingly, seat 118 is higher relative to and positioned closer to vent openings 116. When piston 120 is in the retracted position, the closing apparatus 20 illustrated in FIGS. 10 and 11 operates in much the same manner as the closing apparatuses described above for FIG. 3 and illustrated in the other figures. That is, oil escaping through opening 22 of riser pipe 24 enters into the engagement cylinder 92 and exhausts through vent openings 116. However, when the piston 120' is moved to its downward or extended sealed position (as shown in phantom lines, FIGS. 10 and 11), a lower end portion of arm 126 enters opening 22 of the riser pipe 24 and sealing members 128 positioned on arm 126 engage the interior surface 129 of riser pipe 24, sealing closed the flow of oil out of opening 22 In this downward or sealed position of piston 120' within riser pipe 24, piston 120' also blocks and seals off vent openings 116, thereby also preventing oil from escaping through vent openings 116. In this exemplary embodiment, piston 120' is still capable of stopping oil from escaping riser pipe 24 by plugging opening 22 in riser pipe 24. This embodiment depends more on the uniform configuration of the interior diameter of riser pipe 24 than the embodiment shown in FIG. 3, which does not have piston 120' enter riser pipe 24.

Referring now to FIGS. 13-19, embodiments of the apparatus including a method for closing and reopening a pipe are shown. Components of the apparatus for closing and reopening a pipe that are illustrated in FIGS. 13-19 similar to components illustrated in FIGS. 1-12 are identified with the same reference number and a "D".

With respect to FIGS. 13-16, an embodiment of using pipe closing apparatus 20D as part of the original equipment in constructing a deep water oil well is shown. In referring to FIG. 13, oil rig platform 180D is positioned at the water surface and is configured to drill beneath the ocean floor 23 through riser pipe 24D and through blow out preventer 182D.

Figure 13:
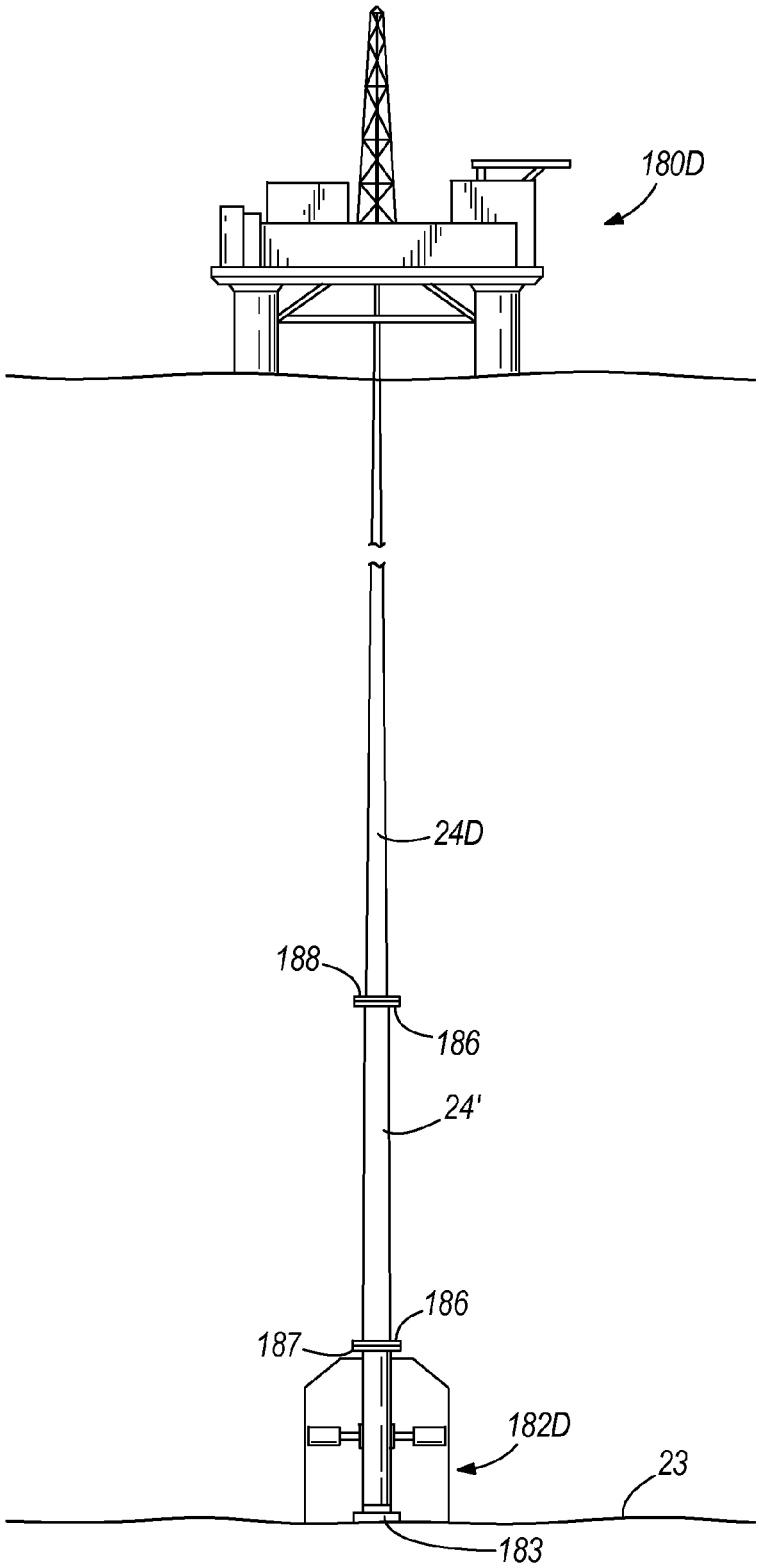
FIG. 13 is a schematic view of an embodiment of a deep water oil platform in a drilling configuration with a riser pipe extending downwardly with a section of riser pipe connecting to a blow out preventer.

In construction of the oil well, blow out preventer 182D is positioned over, in this example, a sub sea well head 183 at the ocean floor 23. In this embodiment, as seen in FIG. 13, riser pipe 24D is assembled from sections of riser pipe being connected on oil rig platform 180D. Typically, in this embodiment, as sections of riser pipe are added to riser pipe 24D, riser pie 24D is lowered into the water. In this example, the leading section being riser pipe section 24' is the first section to be connected to blow out preventer 182D. In other embodiments, riser pipe section 24' may be positioned in other locations along riser pipe 24D. In this embodiment, riser pipe section 24' connects riser pipe 24D with blowout preventer 182D. In this embodiment and as will be appreciated herein, riser pipe section 24' will be of a certain predetermined length. Riser pipe section 24' has opposing flanges 186. The upper flange 186 is compatible with and will connect to flange 188, a flange connected to a lower portion of riser pipe 24D. This connection between upper flange 186 and flange 188 can be made, as mentioned above, on the oil rig platform 180D. The securing of upper flange 186 to flange 188 is accomplished, in this example, with the use of securing nuts and bolts together that are positioned spaced apart around the respective flanges resulting in the securing of the abutting flanges together.

Oil rig platforms can come in many known configurations and constructions. Theses configurations and constructions are generally the locations from which the drilling operations are conducted. Some of these structures temporarily collect and store the oil and/or gas collected from the well until it can be taken to shore and in other instances what is collected from the well is piped from the structure to shore. In some instances, these structures will also house the crew. There are numerous known oil rig platforms such as fixed platforms, compliant towers, tension-leg platforms, gravity based structures, spar platforms, semi-submersed platforms, jack-up rigs, floating systems including drill ships, floating production systems, toadstool platforms, satellite platforms and others. For purposes of this disclosure an oil well rig system comprises an oil rig platform, riser pipe and associated drilling equipment for drilling a well.

In this embodiment, with riser pipe 24D lowered into position above blow out preventer 182D, lower flange 186 of riser pipe section 24' is positioned to connect to flange 187 of blow out preventer 182D. With flange 187 and lower flange 186 abutting one another, nuts and bolts positioned spaced apart around the respective flanges are secured together thereby securing the abutting flanges together. In this embodiment, the bolting of flanges 186 and 187 together can be accomplished with the use of under water robotic devices. In other embodiments, flanges 186 and 187 can be secured on oil rig platform 180D prior to lowering of blow out preventer 182D. With riser pipe 24D, riser pipe section 24' and blow out preventer 182D connected, as seen in FIG. 13, drill rig platform 180D is prepared to commence drilling toward the target oil reservoir positioned below ocean floor 23, for example, through riser pipe 24, section of riser pipe 24' and blow out preventer 182D.

Blow out preventers come in a variety of configurations which include ram type and/or annular type mechanisms, for closing the well. The drill mechanism or string is typically encased within a drill pipe that is positioned inside of riser pipe 24D. With the drill pipe positioned within riser pipe 24D, an annular space is positioned between the inside surface of riser pipe 24D and the outside surface of the drilling pipe. This holds true also for riser pipe section 24'. In this embodiment, with riser pipe section 24' connected to upper portion of blow out preventer 182D, the riser pipe typically terminates at that point, the drill pipe containing the drilling mechanism continues to extend through blow out preventer 182D.

Thus, during the drilling operation, in this example, the drill pipe is contained within blow out preventer 182D wherein, an annular space is positioned between the outside surface of the drill pipe and blow out preventer 182D. This annular space, as does, the annular space in riser pipe 24D and 24' allows for material/debris being drilled out to create the well bore, as well as, a medium such as drilling mud, and the like, to pass upwardly within the annular space within blow out preventer 182D, riser pipe section 24' and riser pipe 24D during the drilling process. The material/debris and medium travels upwardly to platform 180D at the surface through the annular openings positioned outside of the drill pipe.

During the drilling process, should an extraordinary rise in pressure or "kick" occur, blow out preventer 182D can be employed using an annular closure mechanism, for example, to encapsulate the drill pipe and close the annular space between the drill pipe and blow out preventer 182D. With this annular space closed, this pressure is prevented from entering the annular space within riser pipe 24D and reaching the oil rig platform 180D. An example of such a blow out preventer which has an annular closure mechanism can be seen as the device shown in Publication US 2008/0023917, published Jan. 31, 2008 and assigned to Hydril Company LP.

In circumstances, where an extraordinary pressure rise is not controllable, rams within a blow out preventer 182D can be employed that can physically shear the drill pipe including the well tools contained therein and close the well bore permanently. Thus, a blow out preventer, at this stage of the drilling operation can encapsulate the drill pipe or even shear it and thereby permanently close the well when necessary.

With the drilling operation completed and the drill has reached the oil reservoir, in this embodiment, the drilling tools and drilling pipe are removed from blow out preventer 182D, riser pipe section 24' and riser pipe 24D. The well is now producing oil, wherein the oil reaches the surface through riser pipe 24D. At this point, the operator deploys the annular closure mechanism of the blow out preventer 182D, as shown in the above-identified US2008/0023917 Publication and for the time being, closes the well. At this point, oil is not flowing through the subsea well head 183 or through blowout preventer 182D. With the well closed, any oil contained in riser pipe 24D and section of riser pipe 24' can now be evacuated of its contents by various means including pumping.

Figure 14:
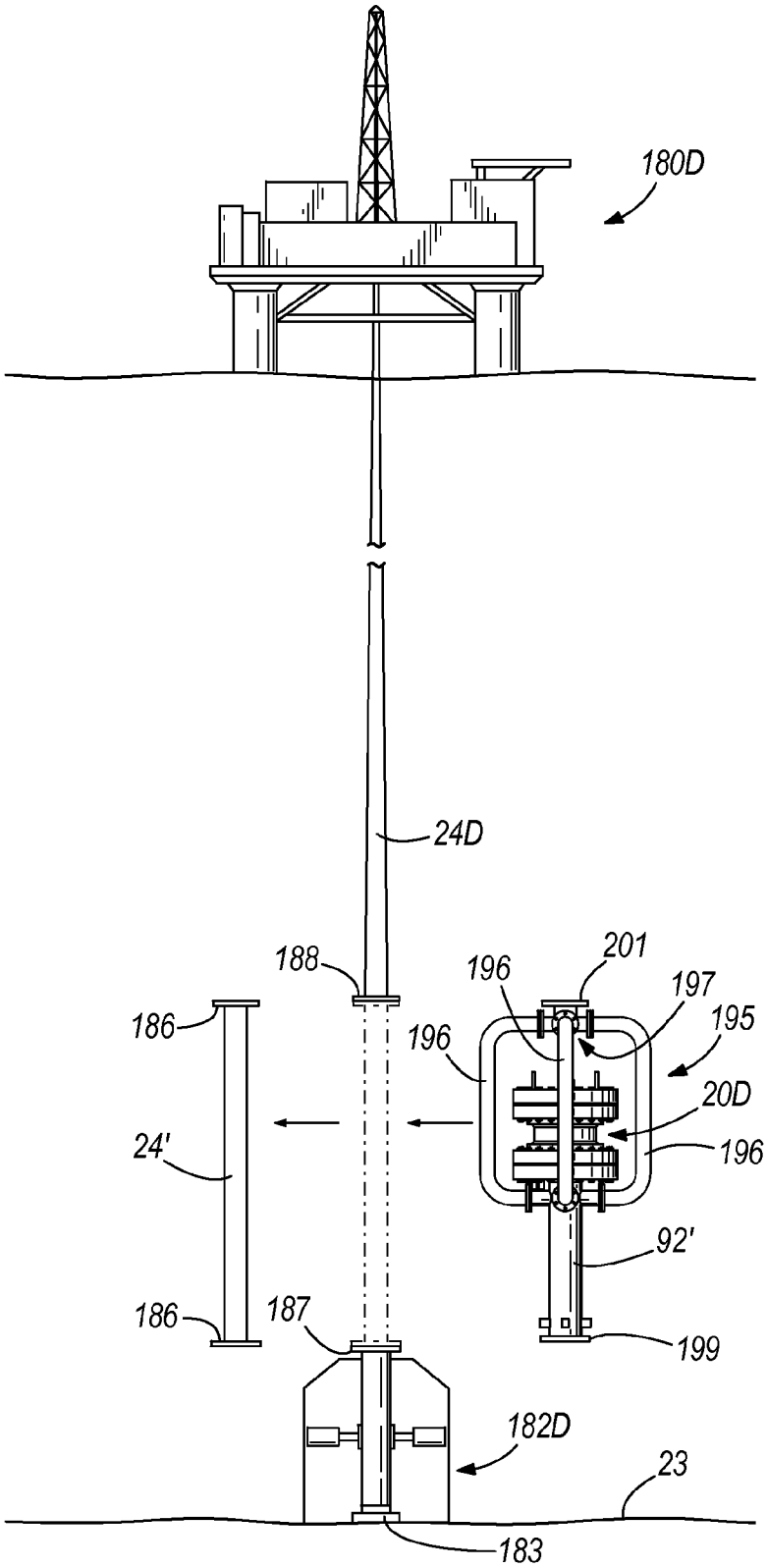
FIG. 14 is a schematic view of FIG. 13 wherein a section of the riser pipe has been removed from connection with the blow out preventer and the upper portion of the riser pipe, with the blow out preventer in a closed position and pipe closing apparatus position to be moved into alignment and secured to the upper portion of the riser pipe and the blow out preventer.

With the oil evacuated from riser pipe 24D and section of riser pipe 24', section of riser pipe 24' can now be disconnected from blow out preventer 182D and from the remaining portion of riser pipe 24D, as seen in FIG. 14. This disconnection can be accomplished with the use of underwater robotic devices that would unbolt upper flange 186 from flange 188 and the other flange 186 from flange 187 of blow out preventer 182D. Once riser pipe section 24' is unbolted, it can be moved away from alignment with the remaining portion of riser 24D and blow out preventer 182D with the assistance of one or more deep sea robotic devices. The remaining portion of riser pipe 24D, in this embodiment, can be held in position with the assistance of a crane associated with oil rig platform 180D and can be assisted with buoyant members associated with riser pipe 24D. In this embodiment, the space left between the remaining portion of riser pipe 24D and blow out preventer 182D from removal of riser section 24', is substantially equivalent to the height of the pipe closing apparatus 20D with manifold 195, assembly, as seen in FIG. 14.

Figure 15:
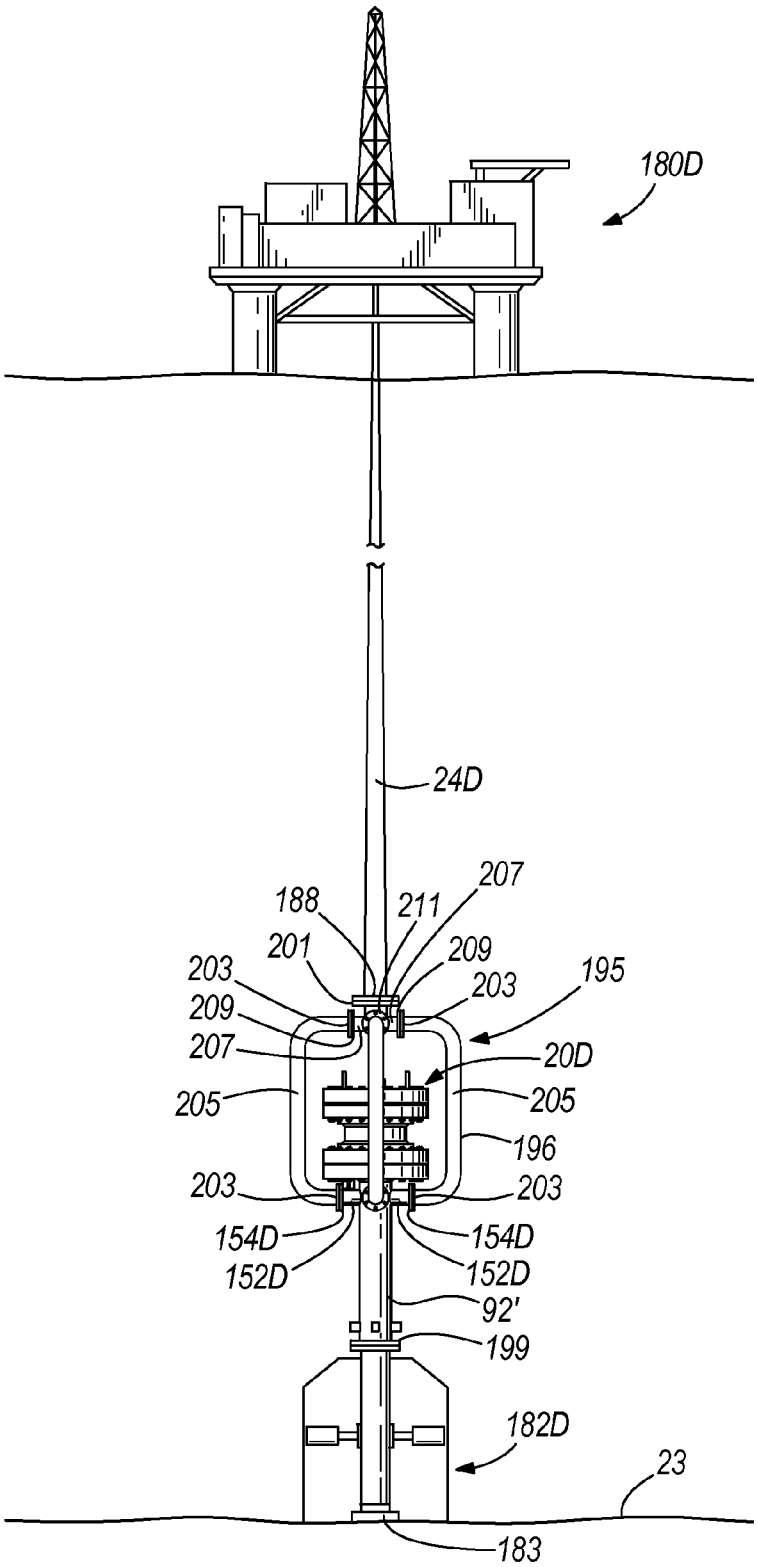
FIG. 15 is a schematic view of FIG. 17 with the pipe closing apparatus secured to the upper portion of the riser pipe and to the blow out preventer with the blow out preventer now in an open position.

With again the assistance of deep sea robotic devices, pipe closing apparatus 20D and manifold 195, assembly can be moved into alignment with blow out preventer 182D and riser pipe 24D. In this embodiment, engagement cylinder 92' of pipe closing apparatus 20D is not constructed to envelope a broken riser pipe but instead is configured with flange 199 compatible to flange 187 of blow out preventer 182D. Similarly, flange 201, positioned on the upper portion of pipe closing device 20D and manifold 195 assembly, is provided to connect the same to compatible flange 188 of riser pipe 24D. With flanges 199 and 187 abutting and in alignment and with flanges 201 and 188 abutting and in alignment, these abutting flanges can be bolted together with the assistance of a deep sea robotic device. These flanges are secured similarly as that described herein for abutting flanges. With the bolts and nuts tightened, riser pipe 24D, pipe closing device 20D, and blow out preventer 182D are now connected and ready for operation of the well, as seen in FIG. 15. With arm 126 in a retracted position within closing apparatus 20D and the annular closure mechanism within blow out preventer 182D opened, oil will flow upwardly through blow out preventer 182D, engagement cylinder 92', manifold 195 and upward into riser 24D to platform 180D.

In this example, manifold 195 comprises four individual pipe assemblies 196 (one not shown based on the view) each of which is in fluid communication respectively with one of four vent openings 116 which are symmetrically spaced about engagement cylinder 92'. This configuration of vent openings 116 is similar to what is shown in FIGS. 3, 10 and 11. The four individual pipe assemblies 196 that comprise manifold 195, are positioned to direct the flow of oil coming from blow out preventer 182D upwardly through the four pipe assemblies 196 which then direct the flow of oil to converge at juncture 197 positioned above pipe closing apparatus 20D.

In referring to FIG. 15, manifold 195 comprises, in this example, nozzles 152D having flanges 154D. Nozzles 152D are in fluid communication with vent openings 116. In turn, compatible flanges 203 provided on opposing ends of generally U-shaped pipe 205 of pipe assembly 196. At the lower end of pipe assembly 196, each flange 203 abuts and connects to a corresponding flange 154D by way as described earlier herein with respect to securing abutting flanges with bolts being tightened to nuts about the flanges. At an upper portion of each pipe assembly 196, wherein there are four in this embodiment, nozzle 207 is provided for each assembly 196 and each with a flange 209 secured to the end of each nozzle 207. Each nozzle 207 is in fluid communication with an opening (not shown) in a portion of pipe 211 extending upwardly toward riser 24D. Flange 201 is secured to pipe 211. Flange 201 is compatible with and abuts and secures to flange 188 of riser pipe 24D. As described herein, with respect to securing abutting flanges, these abutting flanges are similarly secured together with the use of nuts and bolts being tightened to one another.

With assembly of pipe closing apparatus 20D and manifold 195 secured into position, pipe closing apparatus 20D is now operable for opening and closing the flow of oil and/or undesirable gases and/or pressurized fluids up riser pipe 24D. Arm 126 of apparatus 20D can be placed in a retracted position allowing oil to flow out of vent openings 116, and upwardly through manifold 195 and thereafter up riser 24D to platform 180D. Should the occasion arise that the well operation needs to be stopped, such as an occurrence of a kick, instead of attempting to close the well from a radial direction with an annular closing device within a blow out preventer 182D or possibly permanently closing the well with, for example, a shear ram within blow out preventer 182D, arm 126 of pipe closing apparatus 20D can be deployed to close vent openings 116 and thereby stop the flow of oil from moving into manifold 195 and prevent any unwanted high pressured, gases and/or fluids from going up riser pipe 24D to oil drilling rig platform 180D. Such closure of arm 126 will prevent undesirable events from occurring from an unwanted kick or other pressurized anomalies. The flow coming up from lower regions of the well will not move through the subsea wellhead 183 or through, in this embodiment, blowout preventer 182D, with arm 126 in a blocking position with vent openings 116. As further described herein, arm 126 can be retracted once deployed and oil will be permitted to flow once again. As described herein, arm 126 can be moved to a retracted or to a deployed position, as desired, by the operator of the well thereby allowing oil from the well to flow or not to flow.

Figure 16:
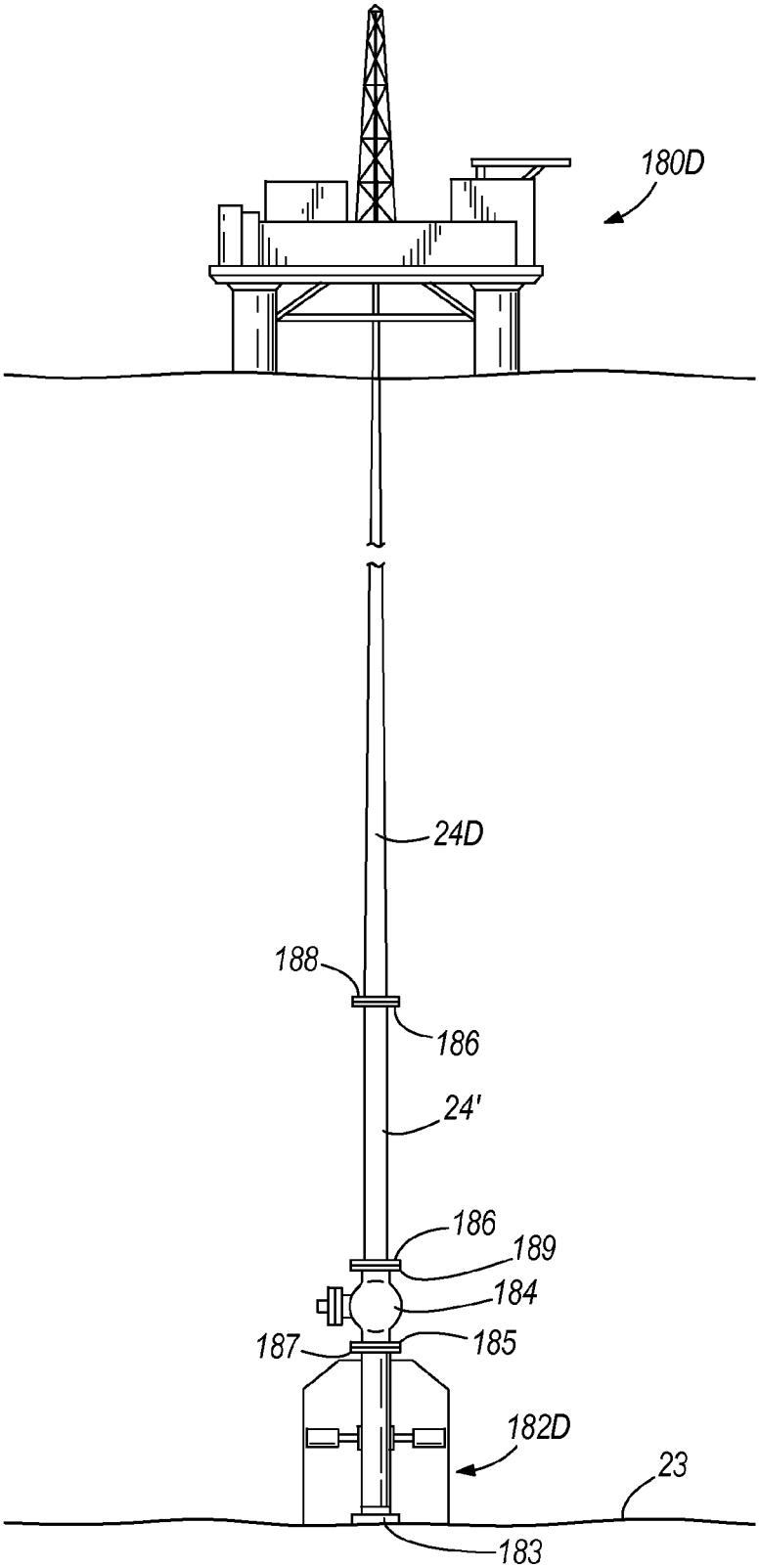
FIG. 16 is a schematic view of another embodiment of a deep water oil platform in a drilling configuration with a riser pipe extending down to connect to a valve member which, in turn, is connected to a blow out preventer.
Figure 17:
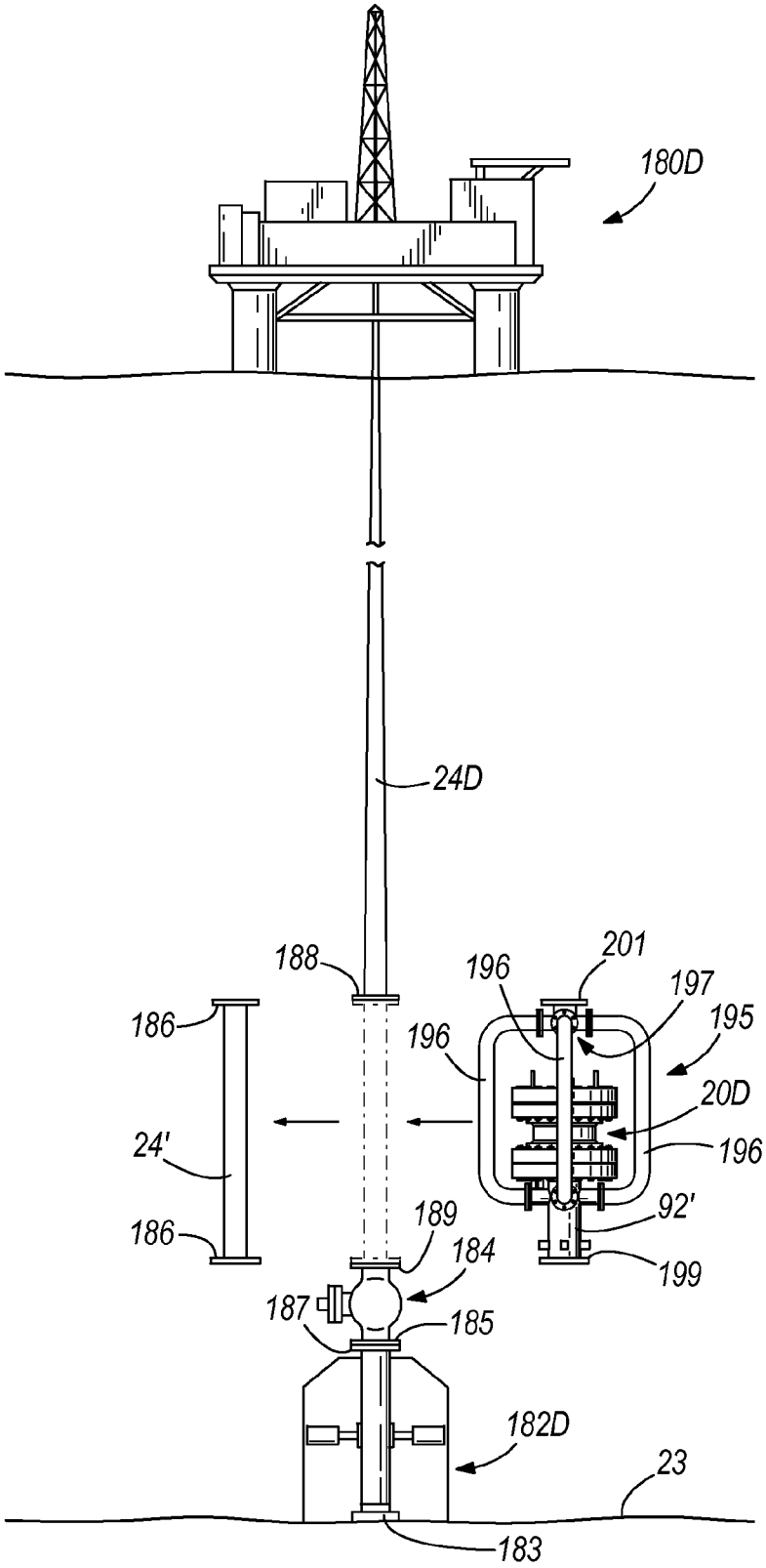
FIG. 17 is the schematic view of FIG. 16 wherein a section of the riser pipe has been removed from connection with the valve member and the upper portion of the riser pipe, with the valve in a closed position and the pipe closing apparatus positioned to be moved into alignment and secured to the upper portion of the riser pipe and the valve member.
Figure 18:
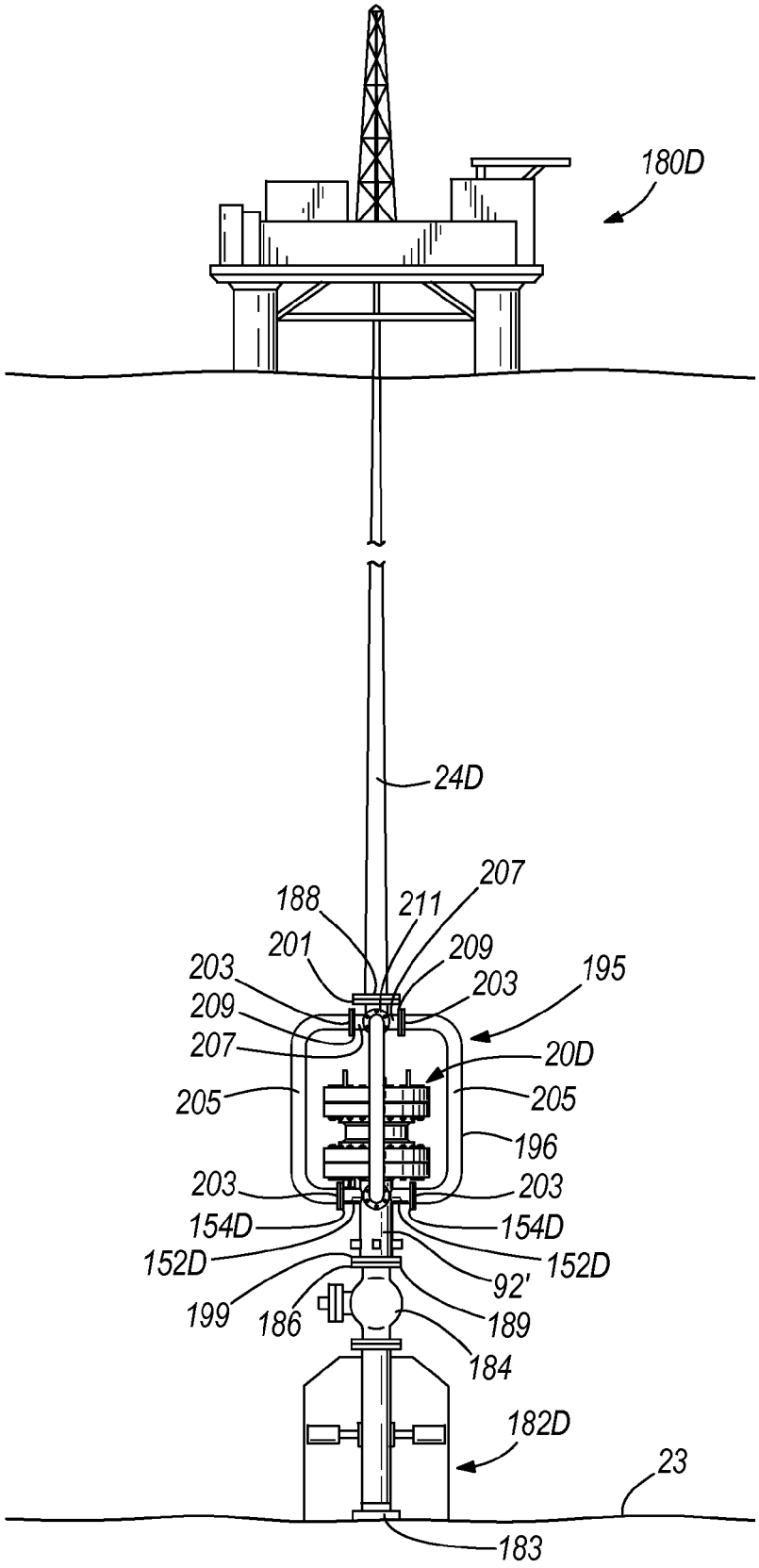
FIG. 18 is a schematic view of the FIG. 17 with the pipe closing apparatus secured to the upper portion of the riser pipe and to the valve member, with the valve member now in an open position.

In another embodiment set forth in FIGS. 16-18, valve 184 is connected to and positioned between blowout preventer 182D and section of riser pipe 24'. Valve 184 will be of suitable construction to allow a drill pipe or string to pass through valve 184 and permit drilling with valve 184 in an open position. Valve 184 may include a full port ball valve or even a gate valve, or the like. Such types of valves that can withstand as much pressure of at least 10,000 psi or greater, can be found and be manufactured by Kata (Kaitai) Valve Group.

In this embodiment, a full port ball valve 184 is used such as a CHA90. Valve 184, in this example, is connected to blow out preventer 182D with flange 185 of valve 184 and flange 187 of blow out preventer 182D wherein these flanges are connected together with securing corresponding nuts and bolts together as described herein. These flanges are constructed to extend outwardly and circumferentially from the device to which it is connected. An example of a set of flanges like 185 and 187, can be seen, as flanges 162 and 166 in FIG. 8. The securing of flanges 185 and 187 can be accomplished in a number of conventional ways, however, in this example, flanges 185 and 187 are secured together with a plurality of bolts and nuts positioned, as has been described herein for connecting other abutting flanges, through openings provided in both flanges 185 and 187. These bolts are positioned spaced apart about the entire flange and with the nuts and bolts tightened together flanges 185 and 187 are secured together. This securing can be accomplished before the blow out preventer is lowered to its position on ocean floor 23 or in other embodiments this connection can be made with the assistance of under water robotic devices.

In turn, valve 184 is connected to the oil rig platform 180D above through riser pipe 24D. In this embodiment, a section of riser pipe 24' is positioned between valve 184 and riser pipe 24D. Section of riser pipe 24' includes a pair of opposing flanges 186 that will connect to compatible flanges 188 and 189, as seen in FIG. 16. Upper flange 186 is connected to flange 188 of riser pipe 24D and the other flange 186 is connected to flange 189 of valve 184. These opposing sets of flanges 186, 188 and 186, 189 are connected together with the tightening together the nuts and bolts positioned spaced apart around the respective flanges thereby securing the abutting flanges 186, 188 and 186, 189 to one another, as been described herein. In this embodiment, flange 186 and 188 can be connected on drill rig 180D and the connection of flanges 186 and 189 can be made with the assistance of an underwater robotic device.

With the two sets of flanges, 186, 188 and 188, 189, secured together, as seen in FIG. 16, valve 184 which is connected to blow out preventer 182D, can be placed in an open position. Valve 184 in this embodiment can be placed in an open position or if closed, can be opened with the assistance of underwater robotic devices or by known remote control. With valve 184 in an opened position drill pipe with its drilling assembly can be extended from riser pipe section 24', through valve 184 and through blow out preventer 182D. Typically, in this embodiment, riser pipe does not extend beyond its connection to valve 184. In another embodiment valve 184 may be secured to riser pipe section 24' prior to submerging both riser pipe section 24' and valve 184 and then connecting valve 184 to blow out preventer 182D with the assistance of under water robotic devices.

With riser pipe 24D, riser pipe section 24', valve 184 and blow out preventer 182D connected, and with valve 184 in an open position, drilling pipe carrying its drilling assembly mechanism therein, can be positioned to extend through riser pipe 24D, riser pipe section 24', valve 184 and blow out preventer 182D. In this configuration of this embodiment, riser pipe terminates at the connection with valve 184. As described above, drilling pipe forms an annular space between its external surface and the internal surface of riser pipe 24D and riser pipe section 24'. Similarly, drilling pipe forms an annular space between its external surface and valve 184 and its external surface and blow out preventer 182D. As described earlier, these annular spaces provide an opening through which material/debris being drilled out to form the well bore and a medium, such as a drilling mud, and the like pass upwardly though these annular openings to drilling rig platform 180D.

In this embodiment, with the drilling pipe and its associated drilling assembly in position, the drilling can commence. During the drilling process, should an extraordinary rise in pressure or "kick" occur, blow out preventer 182D can be employed using an annular closure mechanism, for example as mentioned above, to encapsulate the drill pipe and close the annular space between the drill pipe and blow out preventer 182D. With this annular space closed, this pressure is prevented from entering the annular space within riser pipe 24D and reaching the oil rig platform 180D. An example of such a blow out preventer which has an annular closure mechanism can be seen as the device shown in Publication US 2008/0023917, published Jan. 31, 2008 and assigned to Hydril Company LP.

In circumstances, where an extraordinary pressure rise is not controllable, rams within a blow out preventer 182D can be employed that can physically shear the drill pipe including the well tools contained therein and close the well permanently. Thus, a blow out preventer, at this stage of the drilling operation can encapsulate the drill pipe or even shear it and thereby permanently close the well when necessary.

With the drilling operation completed and the well has reached the oil reservoir, in this embodiment, the drilling tools and drilling pipe are removed from blow out preventer 182D, valve 184, riser pipe section 24' and riser pipe 24D. The well is now producing oil, wherein the oil reaches the surface through riser pipe 24D. At this point, valve 184 can now be closed. At the point valve 184 is closed, no oil or gas will flow through subsea well head 183 or blowout preventer 182D. With the well closed, any oil contained in riser pipe 24D and section of riser pipe 24' can now be evacuated. This can be done by pumping out the contents or other conventional means.

With the contents evacuated from riser pipe 24D and section of riser pipe 24', section of riser pipe 24' can be disconnected from valve 184 and from riser pipe 24D, as seen in FIG. 17. This disconnection can be accomplished with the use of underwater robotic devices that would unbolt upper flange 186 from flange 188 and the other flange 186 from flange 189, of valve 184. Once riser pipe section 24' is unbolted, it can be moved away from alignment with riser 24D and valve 184 with the assistance of one or more deep sea robotic devices or other known means. Riser pipe 24D can be held in position with the assistance of a crane associated with oil rig platform 180D and assisted with buoyant members associated with riser pipe 24D. In this embodiment, the space left between riser pipe 24D and valve 184 from removal of riser pipe section 24', is equivalent to the height of the pipe closing apparatus 20D with manifold 195, assembly, as seen in FIG. 17.

With again the assistance of deep sea robotic devices, pipe closing apparatus 20D and manifold 195, assembly can be moved into alignment with valve 184 and riser pipe 24D. In this embodiment, engagement cylinder 92' of pipe closing apparatus 20D is not constructed to envelope a broken riser pipe but instead is configured, in this embodiment, such that engagement cylinder 92' is adapted to receive and secure to flange 199 which is compatible easy to secure to flange 189 of valve 184. Similarly, flange 201, positioned on the upper portion of pipe closing device 20D and manifold 195, assembly, is provided to connect the same to compatible flange 188 of riser pipe 24D. With flanges 199 and 189 abutting and in alignment and with flanges 201 and 188 abutting and in alignment, these abutting flanges can be bolted together with the assistance of a deep sea robotic device. These flanges are secured similarly as that described herein for abutting flanges. With the bolts and nuts tightened, riser pipe 24D, pipe closing device 20D, valve 184 and blow out preventer 182D are now connected and ready for operation of the well, as seen in FIG. 18. With arm 126 in a retracted position within closing apparatus 20D and valve 184 in an opened position, oil will be allowed to flow upwardly through blow out preventer 182D, valve 184, engagement cylinder 92', manifold 195 and upward into riser 24D to platform 180D.

In this example, as described above manifold 195 comprises four individual pipe assemblies 196 (one not shown based on the view) each of which is in fluid communication respectively with one of four vent openings 116 which are symmetrically spaced about engagement cylinder 92'. This configuration of vent openings 116 is similar to what is shown in FIGS. 3, 10 and 11. The four individual pipe assemblies 196 that comprise manifold 195, are positioned to direct the flow of oil coming from valve 184 upwardly through the four pipe assemblies 196 which then direct the flow of oil to converge at juncture 197 positioned above pipe closing apparatus 20D, as shown in FIG. 17.

In referring to FIG. 18, manifold 195 comprises, in this example, nozzles 152D having flanges 154D. Nozzles 152D are in fluid communication with vent openings 116. In turn, compatible flanges 203 provided on opposing ends of generally U-shaped pipe 205 of pipe assembly 196. At the lower end of pipe assembly 196, each flange 203 abuts and connects to a corresponding flange 154D by way as described earlier herein with respect to securing abutting flanges with bolts being tightened to nuts about the flanges. At an upper portion of each pipe assembly 196, wherein there are four in this embodiment, nozzle 207 is provided for each assembly 196 and each with a flange 209 secured to the end of each nozzle 207. Each pipe assembly 196 is connected to a nozzle 207 with corresponding compatible flanges 203 and 209 abutted together and secured together by way as described earlier herein with respect to securing abutting flanges with bolts being tightened to nuts about the flanges. Each nozzle 207 is in fluid communication a pipe assembly 196 and with an opening (not shown) in a portion of pipe 211 which extends upwardly toward riser 24D. Flange 201 is secured to pipe 211. Flange 201 is compatible with and abuts and secures to flange 188 of riser pipe 24D. As described herein, with respect to securing abutting flanges, these abutting flanges are similarly secured together with the use of nuts and bolts being tightened to one another.

With assembly of pipe closing apparatus 20D and manifold 195 secured into position, pipe closing apparatus 20D is now operable for opening and closing the flow of oil and/or undesirable gases and/or pressurized fluids up riser pipe 24D. Arm 126 of apparatus 20D can be placed in a retracted position, with valve 184 in an open position, allowing oil to flow out of vent openings 116, and upwardly through manifold 195 and thereafter up riser 24D to platform 180D. Should the occasion arise that the well operation needs to be stopped, such as an occurrence of a kick, instead of attempting to close the well from a radial direction with an annular closing mechanism within a blow out preventer 182D or possibly permanently closing the well with, for example, a shear ram within blow out preventer 182D, arm 126 of pipe closing apparatus 20D can be deployed to close vent openings 116 and thereby stop the flow of oil from moving into manifold 195 and prevent any unwanted high pressured, gases and/or fluids from going up riser pipe 24D to oil drilling rig platform 180D. Such closure of arm 126 will prevent undesirable events from occurring from an unwanted kick or other pressurized anomalies. As further described herein, arm 126 can be retracted once deployed and oil will be permitted to flow once again. As described herein, arm 126 can be moved to a retracted or deployed position, as desired, by the operator of the well thereby allowing oil from the well to flow or not to flow in this embodiment.

Figure 19:
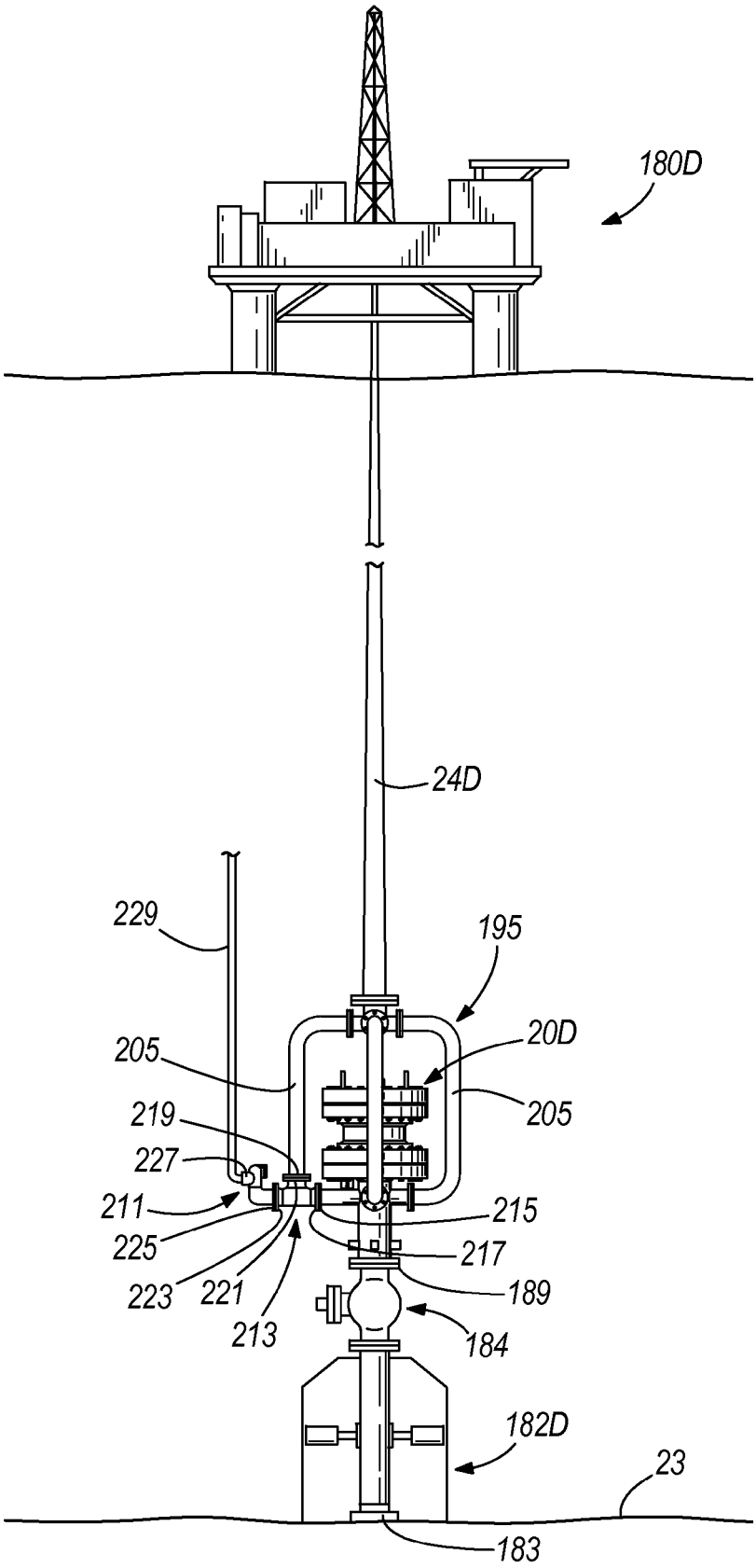
FIG. 19 is a schematic view of another embodiment of that which is shown in FIG. 18 wherein the pipe closing apparatus is associated with a pressure release valve which, in turn, is connected to a vent pipe which extends to the surface.

In referring to the embodiment shown in FIG. 19, an additional feature has been added to the assembly comprising pipe closing apparatus 20D and manifold 195. This additional feature includes securing a pressure release valve 211 in fluid communication with manifold 195. This feature could be utilized in other embodiments described herein. Pressure release valve 211 can be used to accommodate a sudden spike or kick in the well pressure. In this example, pressure release valve 211 is secured to manifold 195 with the use of a T-section of pipe 213. T-section of pipe 213 is secured to manifold 195 with abutting flanges 215, 217 and 219, 221. T-section 213, in turn, is connected to pressure release valve 211 with corresponding compatible abutting flanges 223 and 225. All of these abutting flanges can be secured to one another with the tightening of bolts to corresponding nuts as described herein for other abutting flange connections. During normal operation of the well, with pressure release valve 211 in a closed position, oil will flow into T-section 213 and upwardly through pipe 205 of manifold 195 and upward through riser pipe 24D. Pressure release valve 211 can be selected for its threshold opening pressure for a particular well. In this example, the pressure release valve 211 will have a threshold opening pressure of 5000 psi. Thus upon an occurrence of a sudden spike in pressure within the well that equals or exceeds 5000 psi, pressure release valve 211 will open. The pressurized oil and/or gas will flow through a coupling 227 which connects pressure release valve 211 to vent pipe 229. In turn, the pressurized oil and/or gas then flows up vent pipe 229 to the surface. Vent pipe 229 is positioned at the surface such that oil that exits the vent pipe is captured and collected at the surface. In this embodiment, vent pipe 229 is in the range of 2 to 3 inches of internal diameter. Once the pressure spike anomaly passes and pressure reduces below the pressure release valve 211 threshold pressure, valve 211 will close. On the other hand, should the pressure spike persist, it may be decided that arm 126 should be deployed within pipe closing apparatus 20D thereby shutting off the production of the well and the pressure from reaching the surface at that time.

In this embodiment, the assembly of pressure release valve 211 being connected to manifold 195 and to vent pipe 229 can be done above the water and then lowered down with pipe closing apparatus 20D and manifold 195, assembly. Otherwise, assembly underwater can be provided with the assistance of underwater robotic devices.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

The invention claimed is:

1. A method for installing a pipe closing apparatus in an oil well rig system positioned at least partially in a body of water, comprising the steps of:

shutting off a flow of oil through a well head;

removing a first section of riser pipe from a riser pipe assembly comprising at least the first and a second sections of riser pipe; and connecting the pipe closing apparatus to the second riser pipe section wherein the pipe closing apparatus comprises a housing defining a chamber, the chamber being sealed from an exterior of the housing, a member at least partially positioned within the chamber and moveable relative to the housing, an engagement member secured to the housing wherein the engagement member defines a bore which extends within the engagement member within which the member moves, defines at least one vent opening and defines another opening positioned at a distal end of the engagement member, such that with the member in a first position unblocks the at least one vent opening and in a second position blocks the at least one vent opening.

2. The method of claim 1 wherein the step of connecting the pipe closing apparatus to the second riser pipe section of the riser pipe assembly includes the step of bolting together a flange positioned on the second section of the riser pipe and a flange positioned on the pipe closing apparatus.

3. The method of claim 2 further includes the step of connecting the pipe closing apparatus to a blow out preventer positioned between the pipe closing apparatus and the well head.

4. The method of claim 1, further including the step of providing the housing defining an opening in fluid communication with the chamber and the exterior of the housing.

5. The method of claim 4 further including the step of providing a valve in fluid communication with the opening and positioned between the chamber and the exterior of the housing.

6. The method of claim 5 further including the step of opening the valve to allow fluid to enter the chamber and move the member.

7. The method of claim 1 further including the step of providing at least one seal positioned between the engagement member and the member such that the seal and the member prevent a pressurized fluid located within the engagement member from moving beyond the at least one seal toward the housing.

8. The method of claim 1 further including the step of providing the member with a top portion positioned within the chamber, the top portion comprising a top surface that defines a boundary of an upper chamber with the chamber.

9. The method of claim 8 further including the step of providing the top portion further comprising a bottom surface that defines a boundary for a lower chamber within the chamber.

10. The method of claim 8 further including the step of providing the opening in fluid communication with the upper chamber.

11. The method of claim 10 including the step of providing a second opening defined in the housing in fluid communication with the upper chamber and the exterior of the housing and a second valve in fluid communication with the second opening and positioned between the upper chamber and the exterior of the housing.

12. The method of claim 9 further including the step of providing a third opening defined in the housing in fluid communication with the lower chamber and the exterior of the housing and a third valve in fluid communication with the third opening and positioned between the lower chamber and the exterior of the housing.

13. The method of claim 9 further including the step of providing at least one sealing member positioned around the top portion and configured to abut the housing to form a seal between the upper and lower chambers.

14. The method of claim 9 further including the step of providing a stop member positioned between the top surface of the top portion and the housing and between the bottom surface of the top portion and the housing.

15. The method of claim 8 further including the step of providing the member comprising an arm connected to the top portion wherein the arm and the top portion are configured generally in a cylindrical shape.

16. The method of claim 15 further including the step of providing a plurality of seals positioned around the arm and spaced apart from one another along the arm.

17. The method of claim 16 further including positioning at least one of the seals positioned between at least one of the vent openings and the chamber with the member in the first position and positioning at least one seal between the vent opening and the chamber with the member in the second position along with another seal positioned between the at least one vent opening and the opening at the distal end.

18. The method of claim 16 further including the positioning the plurality of seals along the arm to maintain the chamber sealed from the exterior of the housing through the engagement member with the member positioned in the first position, second position and positions between the first and second positions.

19. The method of claim 1 further including the step of providing a manifold connected to the at least on vent member.

20. A method for installing a pipe closing apparatus in an oil well rig system positioned at least partially in a body of water, comprising the steps of:

shutting off a flow of oil through a well head;

removing a first section of riser pipe from a riser pipe assembly comprising at least the first and a second sections of riser pipe; and connecting the pipe closing apparatus to a blow out preventer positioned between the well head and the pipe closing apparatus wherein the pipe closing apparatus comprises a housing defining a chamber, the chamber being sealed from an exterior of the housing, a member at least partially positioned within the chamber and moveable relative to the housing, an engagement member secured to the housing wherein the engagement member defines a bore which extends within the engagement member within which the member moves, defines at least one vent opening and another opening positioned at a distal end of the engagement member such that with the member in a first position unblocks the at least one vent opening and in a second position blocks the at least one vent opening.

* * * * *